US009076397B2

(12) United States Patent
Shiobara et al.

(10) Patent No.: US 9,076,397 B2
(45) Date of Patent: Jul. 7, 2015

(54) IMAGE DISPLAY DEVICE AND IMAGE DISPLAY METHOD

(75) Inventors: Naoki Shiobara, Osaka (JP); Hirofumi Murakami, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/343,178

(22) PCT Filed: Aug. 31, 2012

(86) PCT No.: PCT/JP2012/072131
§ 371 (c)(1),
(2), (4) Date: Mar. 14, 2014

(87) PCT Pub. No.: WO2013/035635
PCT Pub. Date: Mar. 14, 2013

(65) Prior Publication Data

US 2014/0225943 A1 Aug. 14, 2014

(30) Foreign Application Priority Data

Sep. 7, 2011 (JP) ..... 2011-195006

(51) Int. Cl.
*G09G 3/36* (2006.01)
*G09G 3/34* (2006.01)

(52) U.S. Cl.
CPC ..... *G09G 3/3607* (2013.01); *G09G 2320/0646* (2013.01); *G09G 3/3413* (2013.01); *G09G 3/3426* (2013.01); *G09G 2320/0233* (2013.01); *G09G 2360/16* (2013.01)

(58) Field of Classification Search
CPC . G09G 3/3607; G09G 3/3413; G09G 3/3426; G09G 2320/0233; G09G 2360/16; G09G 3/36; G09G 3/20; G09G 3/34; G09G 2320/0646; G09G 2320/0242; G09G 3/3406; G09G 3/3611; G09G 2310/0232; G09G 2320/0276; G09G 2320/0285; G09G 2320/0626; G02F 1/133
USPC ..... 345/77, 102, 690, 694
See application file for complete search history.

(56) References Cited

U.S. PATENT DOCUMENTS

2006/0214904 A1* 9/2006 Kimura et al. ..... 345/102
2008/0129680 A1 6/2008 Kimura et al.

(Continued)

FOREIGN PATENT DOCUMENTS

JP 2008-139569 A 6/2008
JP 2009-198530 A 9/2009
WO 2011/040084 A1 4/2011

OTHER PUBLICATIONS

Official Communication issued in International Patent Application No. PCT/JP2012/072131, mailed on Dec. 4, 2012.

*Primary Examiner* — Dmitriy Bolotin
(74) *Attorney, Agent, or Firm* — Keating & Bennett, LLP

(57) ABSTRACT

An object is to moderate the occurrence of mura in an oblique view in an image display device that conducts area active driving. An emission luminance calculator (151) computes a luminance (first emission luminance) (32) of LEDs in respective areas on the basis of an input image (31). The emission luminance corrector (152) applies a correction to the first emission luminance (32) on the basis of correction data (33) in an LED filter (155). Herein, provided that a first image is defined as an image displayed in the case of being externally given an image in which a high-gradation region and a low-gradation region neighbor each other as the input image (31), the emission luminance corrector (152) uses the LED filter (155) to compute a second emission luminance (34), thereby setting the values of correction data (33) stored in the LED filter (155) so as to yield a constant degree of spatial variation in the output gradations between the high-gradation region and the low-gradation region in the case of viewing the first image from a designated oblique direction.

9 Claims, 17 Drawing Sheets

(56) References Cited

U.S. PATENT DOCUMENTS

| | | | | |
|---|---|---|---|---|
| 2010/0013872 | A1* | 1/2010 | Masuda et al. | 345/691 |
| 2011/0090265 | A1* | 4/2011 | Muroi et al. | 345/690 |
| 2012/0075362 | A1* | 3/2012 | Ichioka et al. | 345/690 |
| 2012/0154459 | A1* | 6/2012 | Otoi et al. | 345/690 |
| 2012/0176419 | A1* | 7/2012 | Otoi et al. | 345/690 |
| 2012/0320105 | A1* | 12/2012 | Ueno et al. | 345/690 |
| 2013/0321498 | A1* | 12/2013 | Otoi et al. | 345/694 |

* cited by examiner

FIG. 6

155

| | | | | | | |
|---|---|---|---|---|---|---|
| 0 | 0 | 1 | 2 | 1 | 0 | 0 |
| 0 | 18 | 51 | 81 | 51 | 18 | 0 |
| 1 | 51 | 143 | 168 | 143 | 51 | 1 |
| 2 | 81 | 168 | 255 | 168 | 81 | 2 |
| 1 | 51 | 143 | 168 | 143 | 51 | 1 |
| 0 | 18 | 51 | 81 | 51 | 18 | 0 |
| 0 | 0 | 1 | 2 | 1 | 0 | 0 |

40

FIG. 7

156

| | | | | |
|---|---|---|---|---|
| 0 | 0 | 10 | 0 | 0 |
| 0 | 30 | 50 | 30 | 0 |
| 10 | 50 | 100 | 50 | 10 |
| 0 | 30 | 50 | 30 | 0 |
| 0 | 0 | 10 | 0 | 0 |

FIG. 8

| | | | | | | |
|---|---|---|---|---|---|---|
| (-3, 3) | (-2, 3) | (-1, 3) | (0, 3) | (1, 3) | (2, 3) | (3, 3) |
| (-3, 2) | (-2, 2) | (-1, 2) | (0, 2) | (1, 2) | (2, 2) | (3, 2) |
| (-3, 1) | (-2, 1) | (-1, 1) | (0, 1) | (1, 1) | (2, 1) | (3, 1) |
| (-3, 0) | (-2, 0) | (-1, 0) | (0, 0) | (1, 0) | (2, 0) | (3, 0) |
| (-3, -1) | (-2, -1) | (-1, -1) | (0, -1) | (1, -1) | (2, -1) | (3, -1) |
| (-3, -2) | (-2, -2) | (-1, -2) | (0, -2) | (1, -2) | (2, -2) | (3, -2) |
| (-3, -3) | (-2, -3) | (-1, -3) | (0, -3) | (1, -3) | (2, -3) | (3, -3) |

41

| | | | | | | |
|---|---|---|---|---|---|---|
| 0 | 0 | 0.004 | 0.008 | 0.004 | 0 | 0 |
| 0 | 0.07 | 0.20 | 0.32 | 0.20 | 0.07 | 0 |
| 0.004 | 0.20 | 0.56 | 0.66 | 0.56 | 0.20 | 0.004 |
| 0.008 | 0.32 | 0.66 | 1.00 | 0.66 | 0.32 | 0.008 |
| 0.004 | 0.20 | 0.56 | 0.66 | 0.56 | 0.20 | 0.004 |
| 0 | 0.07 | 0.20 | 0.32 | 0.20 | 0.07 | 0 |
| 0 | 0 | 0.004 | 0.008 | 0.004 | 0 | 0 |

40

| | | | | | | |
|---|---|---|---|---|---|---|
| (I-3, J-3) | (I-2, J-3) | (I-1, J-3) | (I, J-3) | (I+1, J-3) | (I+2, J-3) | (I+3, J-3) |
| (I-3, J-2) | (I-2, J-2) | (I-1, J-2) | (I, J-2) | (I+1, J-2) | (I+2, J-2) | (I+3, J-2) |
| (I-3, J-1) | (I-2, J-1) | (I-1, J-1) | (I, J-1) | (I+1, J-1) | (I+2, J-1) | (I+3, J-1) |
| (I-3, J) | (I-2, J) | (I-1, J) | (I, J) | (I+1, J) | (I+2, J) | (I+3, J) |
| (I-3, J+1) | (I-2, J+1) | (I-1, J+1) | (I, J+1) | (I+1, J+1) | (I+2, J+1) | (I+3, J+1) |
| (I-3, J+2) | (I-2, J+2) | (I-1, J+2) | (I, J+2) | (I+1, J+2) | (I+2, J+2) | (I+3, J+2) |
| (I-3, J+3) | (I-2, J+3) | (I-1, J+3) | (I, J+3) | (I+1, J+3) | (I+2, J+3) | (I+3, J+3) |

| | | | | | | | | | | | | |
|---|---|---|---|---|---|---|---|---|---|---|---|---|
| 0 | | 0 | | 1 | | 2 | | 1 | | 0 | | 0 |
| | | | | | | | | | | | | |
| 0 | | 18 | | 51 | | 81 | | 51 | | 18 | | 0 |
| | | | | | | | | | | | | |
| 1 | | 51 | | 143 | | 168 | | 143 | | 51 | | 1 |
| | | | | | | | | | | | | |
| 2 | | 81 | | 168 | | 255 | | 168 | | 81 | | 2 |
| | | | | | | | | | | | | |
| 1 | | 51 | | 143 | | 168 | | 143 | | 51 | | 1 |
| | | | | | | | | | | | | |
| 0 | | 18 | | 51 | | 81 | | 51 | | 18 | | 0 |
| | | | | | | | | | | | | |
| 0 | | 0 | | 1 | | 2 | | 1 | | 0 | | 0 |

IMAGE DISPLAY DEVICE AND IMAGE DISPLAY METHOD

TECHNICAL FIELD

The present invention relates to an image display device, and more particularly, to an image display device having a function of controlling backlight luminance (a backlight dimming function).

BACKGROUND ART

With liquid crystal display devices and other such image display devices equipped with a backlight, it is possible to moderate the backlight power consumption and improve the image quality of a displayed image by controlling the backlight luminance on the basis of the input image. Particularly, by dividing the screen into multiple areas and controlling the luminance of a backlight source corresponding to a given area on the basis of the input image within that area, further reduction in power consumption and higher image quality becomes possible. Hereinafter, a method of driving a display panel while controlling backlight source luminance on the basis of an input image within an area in this way will be designated "area active driving".

With a liquid crystal display device conducting area active driving, RGB tri-color light-emitting diodes (LEDs) or white LEDs are used as backlight sources. The luminance of the LEDs corresponding to each area is computed on the basis of factors such as the maximum luminance value and mean luminance value of pixels within each area, and is given to a backlight driving circuit as LED data. In addition, display data (data for controlling the optical transmittance of the liquid crystals) is generated on the basis of this LED data and an input image, and this display data is given to a liquid crystal panel driving circuit.

According to a liquid crystal display device as above, suitable display data and LED data is computed on the basis of an input image, the optical transmittance of the liquid crystals is controlled on the basis of the display data, and in addition, the luminance of the LEDs corresponding to each area is controlled on the basis of the LED data. In so doing, an input image may be displayed on a liquid crystal panel. Also, in the case in which pixels within an area have low luminance, the luminance of the LEDs corresponding to that area may be lowered, thereby reducing the backlight power consumption.

Meanwhile, in order to resolve the problem of insufficient luminance during single-area lighting (the case in which only the LEDs corresponding to a given area are in a lighted state) for a liquid crystal display device that conducts area active driving, there has been proposed a per-area luminance correction, which lights not only the area to be lighted (the area to be lighted refers to the area whose LEDs would originally be lighted by single-area lighting), but also the LEDs corresponding to areas near the area to be lighted. Hereinafter, such a correction process will be designated an "LED blur process". According to an LED blur process, the area to be lighted is additionally illuminated by light from nearby areas, thereby resolving the problem of insufficient luminance. Note that an LED blur process is disclosed in Japanese Unexamined Patent Application Publication No. 2009-198530, for example.

CITATION LIST

Patent Literature

PTL 1: Japanese Unexamined Patent Application Publication No. 2009-198530

SUMMARY OF INVENTION

Technical Problem

Meanwhile, in the case in which a liquid crystal display device that conducts area active driving is given an input image in which a high-gradation portion and a low-gradation portion neighbor each other, although the image may be perceived normally from a front view (front view refers to viewing the display screen from a frontal direction), mura due to light bleeding and insufficient luminance may be received from an oblique view (oblique view refers to viewing the display screen from an oblique direction). This mura effect will be explained below.

FIGS. 22 and 23 are diagrams for explaining the viewing angle performance of polarizers used in a liquid crystal display device. In a liquid crystal display device, polarizers are respectively provided in front of and behind the liquid crystal panel. These two polarizers are disposed so that the polarizing axes are mutually orthogonal. With a front view, light is perceived as being transmitted through the polarizing axis 90*a* of the front polarizer and the polarizing axis 90*b* of the rear polarizer, with these two polarizers in a mutually orthogonal state, as illustrated in FIG. 22. Conversely, with an oblique view, light is perceived as being transmitted through the polarizing axis 90*a* of the front polarizer and the polarizing axis 90*b* of the rear polarizer, with these two polarizers not in a mutually orthogonal state, as illustrated in FIG. 23. For this reason, light bleeding may be perceived with an oblique view. If light bleeding occurs, the output gradations perceived by an oblique view in the region of light bleeding will differ from the output gradations perceived by a front view, even though a given, specific image is being displayed. As a result, mura is perceived with the oblique view. Particularly, with a liquid crystal display device that conducts area active driving, since there are many combinations of the above display data and the above LED data for a single output gradation, mura is comparatively noticeable due to factors such as the differences in these combinations among pixels with the same output gradation.

In addition, with a liquid crystal display device that conducts area active driving, disparity also exerts a comparatively large effect on the display image. As illustrated in FIG. 24, some distance (gap) exists between the liquid crystal panel surface and the backlight sources (LEDs, for example). For this reason, the peak position P91 of the light source luminance in a front view differs from the peak position P92 of the light source luminance in an oblique view, as FIG. 24 demonstrates. Consequently, a disparity occurs between the front view and the oblique view. Meanwhile, even if such a disparity hypothetically occurs, in the case in which all light sources are lighted as with a liquid crystal display device of the related art, the luminance distribution is uniform, and thus the disparity exerts little influence on the output gradations. However, with a liquid crystal display device that conducts area active driving, gradation expression is conducted with combinations of the above display data and the above LED data, or in other words, the luminance differs for each light source. For this reason, there is a problem in that mura caused by disparity occurs.

At this point, consider displaying an image that includes a small white window 93 inside a fixed-gradation (for example, a black gradation) background (for example, an image expressing a state of just one star shining in the night sky), as illustrated in FIG. 25. Note that the positions labeled A, B, and C in FIG. 25 respectively correspond to the positions labeled A, B, and C in FIGS. 13 to 15, FIGS. 18 to 20, and FIGS. 26 to 29. In the case of displaying an image like that illustrated in FIG. 25 on a liquid crystal display device that conducts area active driving, the output gradations at each position on the dotted line labeled with the sign 95 become like that illustrated in FIG. 26, and the luminance at each position (the backlight source luminance) becomes like that illustrated in FIG. 27. Also, since the output gradations are obtained by hybridization of liquid crystal gradations and backlight source luminance, the output gradations at each position in a front view become like that illustrated in FIG. 28. Note that liquid crystal gradation corresponds to the above display data, while backlight source luminance corresponds to the above LED data.

As FIGS. 26, 27, and 28 demonstrate, even in portions in which the output gradation is (spatially) constant (the portion labeled with the sign 94 in FIG. 25), the liquid crystal gradation also varies according to backlight source luminance variation (spatial variation, not temporal variation). With an oblique view, because of the effects of liquid crystal viewing angle performance, light bleeding does not readily occur in portions of low luminance and high liquid crystal gradation (the vicinity of the portion labeled with the signs A and B), whereas light bleeding readily occurs in portions of high luminance and low liquid crystal gradation (the vicinity of the portion labeled with the sign C). Also, in the case in which a high-gradation portion and a low-gradation portion neighbor each other, a shift in the luminance distribution (a shift with reference to the luminance distribution in a front view) occurs due to the effects of disparity. As a result, problems such as light bleeding in the low-gradation portion and insufficient luminance in the high-gradation portion occur. Given the above, if an image like that illustrated in FIG. 25 is displayed on a liquid crystal display device that conducts area active driving, the output gradations at each position in an oblique view become like that illustrated in FIG. 29, for example.

As above, with a liquid crystal display device that conducts area active driving, the effects of liquid crystal viewing angle performance and disparity may cause mura to occur in an oblique view, even in cases in which an image is displayed normally in a front view. At this point, it is conceivable to correct the liquid crystal gradations so that the output gradations become correct in the oblique view. However, if such correction is conducted, mura will be perceived in the front view.

Accordingly, the present invention takes as an object to moderate the occurrence of mura in an oblique view with an image display device conducting area active driving.

Solution to Problem

A first aspect of the present invention is an image display device including a backlight made up of a plurality of light sources, and having a function of controlling the luminance of each light source of the backlight, the image display device characterized by comprising:

a display panel, including a plurality of display elements, that displays an image based on an externally given input image;

an emission luminance calculator that divides the input image into a plurality of areas, and on the basis of an input image corresponding to each area, computes a luminance during emission of light sources corresponding to each area as a first emission luminance;

a correction filter that stores correction data for a designated number of areas near a single area;

an emission luminance corrector that computes a second emission luminance by applying the correction filter to each area and correcting the first emission luminance on the basis of the correction data;

a display data calculator that, on the basis of the input image and the second emission luminance, computes display data for controlling optical transmittance of the display elements;

a panel driving circuit that, on the basis of the display data, outputs to the display panel a signal controlling the optical transmittance of the display elements; and a backlight driving circuit that, on the basis of the second emission luminance, outputs to the backlight a signal controlling the luminance of each light source;

wherein, provided that a first image is defined as an image displayed on the display panel in the case of being externally given an image in which a high-gradation region and a low-gradation region neighbor each other as the input image, the emission luminance corrector uses the correction filter to compute the second emission luminance, thereby setting each correction data value stored in the correction filter so as to yield a constant degree of spatial variation in output gradations between the high-gradation region and the low-gradation region in the case of viewing the first image from a designated oblique direction.

A second aspect of the present invention is characterized such that, in the first aspect of the present invention, provided that a target output gradation distribution is defined as a distribution of output gradations that yields a constant degree of spatial variation in output gradations between the high-gradation region and the low-gradation region in the case of viewing the first image from a designated oblique direction, the target output gradation distribution between the high-gradation region and the low-gradation region is expressed by a straight line that passes through an outermost edge portion at which the first emission luminance is correctable by applying the correction filter to areas of the high-gradation region, and a maximal portion of output gradations expressed between the high-gradation region and the low-gradation region while viewing the first image from a designated oblique direction in a hypothetical case of not applying correction to the first emission luminance.

As third aspect of the present invention is characterized such that, in the second aspect of the present invention, a value of the correction data is set to a value of a difference between a luminance of the backlight obtained on the basis of a system of equations made up of a first equation expressing a distribution of output gradations in the case of viewing the first image from a front direction and a second equation expressing the target output gradation distribution, and a luminance of the backlight in a hypothetical case of not applying a correction to the first emission luminance.

A fourth aspect of the present invention is characterized such that, in the third aspect of the present invention, the first equation is expressed by the following formula (Eq1):

[Math. 1]

$$\alpha = \left(G^{\gamma} \cdot \frac{L}{L\max}\right)^{\frac{1}{\gamma}} \quad \text{(Eq 1)}$$

and the second equation is expressed by the following formula (Eq2):

[Math. 2]

$$\beta = \left((f(G)\cdot G)^{\gamma}\cdot\frac{L}{L\max}\right)^{\frac{1}{\gamma}} \quad \text{(Eq 2)}$$

where G is a gradation based on the display data, L is a luminance of the light sources, Lmax is a maximum value of the luminance of the light sources, f(G) is a function expressing gradation performance while viewing an image from an oblique direction, $\gamma$ is a gamma value, $\alpha$ is an output gradation in the case of viewing the first image from a front direction, and $\beta$ is an output gradation in the case of viewing the first image from the designated oblique direction.

A fifth aspect of the present invention is characterized such that, in the first aspect of the present invention, the emission luminance corrector computes the second emission luminance so that the difference between the second emission luminance and the first emission luminance is less than or equal to a predetermined limit.

A sixth aspect of the present invention is characterized such that, in the first aspect of the present invention, the emission luminance corrector computes the second emission luminance so that the second emission luminance is equal to or greater than a predetermined lower limit.

A seventh aspect of the present invention is characterized such that, in the first aspect of the present invention, a plurality of correction filters are provided in advance, and the emission luminance corrector selects a correction filter to use while correcting the first emission luminance according to the input image.

An eighth aspect of the present invention is characterized such that, in the first aspect of the present invention, every time an input image is externally given, each correction data value stored in the correction filter is computed on the basis of that input image.

A ninth aspect of the present invention is an image display method for an image display device equipped with a display panel that includes a plurality of display elements and displays an image based on an externally given input image, and a backlight made up of a plurality of light sources, the image display method characterized by comprising:

an emission luminance calculating step that divides the input image into a plurality of areas, and on the basis of an input image corresponding to each area, computes a luminance during emission of light sources corresponding to each area as a first emission luminance;

an emission luminance correcting step that computes a second emission luminance by applying a correction filter storing correction data to each of a designated number of areas near a single area, and correcting the first emission luminance on the basis of the correction data;

a display data calculating step that, on the basis of the input image and the second emission luminance, computes display data for controlling optical transmittance of the display elements;

a panel driving step that, on the basis of the display data, outputs to the display panel a signal controlling optical transmittance of the display elements; and a backlight driving step that, on the basis of the second emission luminance, outputs to the backlight a signal controlling the luminance of each light source;

wherein, provided that a first image is defined as an image displayed on the display panel in the case of being externally given an image in which a high-gradation region and a low-gradation region neighbor each other as the input image, the emission luminance correcting step uses the correction filter to compute the second emission luminance, thereby setting each correction data value stored in the correction filter so as to yield a constant degree of spatial variation in output gradations between the high-gradation region and the low-gradation region in the case of viewing the first image from a designated oblique direction.

Advantageous Effects of Invention

According to the first aspect of the present invention, in an image display device having a function of controlling the luminance of each light source in a backlight, the emission luminance of the light sources corresponding to respective areas are computed on the basis of an input image, and then an emission luminance corrector uses a correction filter to correct that emission luminance. Herein, the values of correction data within the correction filter are set so as to yield a constant degree of spatial variation in output gradations between a high-gradation region and a low-gradation region in the case of viewing an image in which a high-gradation region and a low-gradation region from an oblique direction. For this reason, the spatial variation in output gradations between a high-gradation region and a low-gradation region in the case of taking an oblique view becomes smoother than in the related art. As a result, the occurrence of mura in an oblique view is moderated.

According to the second aspect of the present invention, it becomes possible to moderate the occurrence of mura in an oblique view by conducting a systematic process.

According to the third aspect of the present invention, it becomes possible to more reliably moderate the occurrence of mura in an oblique view by computing correction data values on the basis of a system of equations.

According to the fourth aspect of the present invention, it becomes possible to more reliably moderate the occurrence of mura in an oblique view, similarly to the third aspect of the present invention.

According to the fifth aspect of the present invention, the increment in the luminance of the light sources due to correction is limited to within a fixed range, thereby moderating increases in power consumption.

According to the sixth aspect of the present invention, even in the case of a large gradation differential between a high-gradation portion and a low-gradation portion, light sources in the low-gradation portion emit light at a fixed or greater brightness as a result of setting a lower limit to a suitable value, and thus the degree of variation in output gradations between the high-gradation portion and the low-gradation portion becomes smaller. For this reason, the occurrence of mura in an oblique view is moderated more effectively.

According to the seventh aspect of the present invention, emission luminance is corrected by using a correction filter includes correction data set to more suitable values according to an input image. For this reason, the occurrence of mura is effectively moderated, irrespective of the content of the input image.

According to the eighth aspect of the present invention, the occurrence of mura is effectively moderated, irrespective of the content of the input image, similarly to the seventh aspect of the present invention.

According to the ninth aspect of the present invention, advantageous effects similar to the first aspect of the present invention may be exhibited in the invention of an image display method.

BRIEF DESCRIPTION OF DRAWINGS

FIG. 6 is a diagram illustrating an example of an LED filter.

FIG. 7 is a diagram illustrating an example of a luminance diffusion filter.

FIG. 8 is a diagram for describing local coordinates.

DESCRIPTION OF EMBODIMENTS

Hereinafter, exemplary embodiments of the present invention will be described with reference to the attached drawings.

<1. First Embodiment>

<1.1 Overall Configuration and General Operation>

Figure 2:
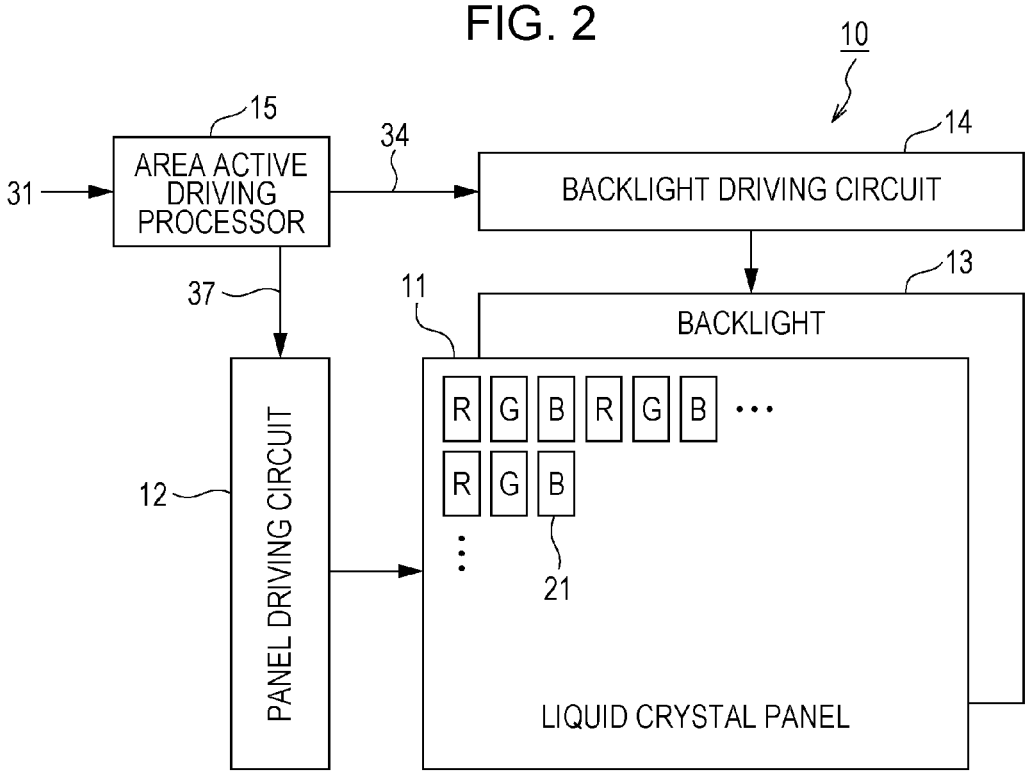
FIG. 2 is a block diagram illustrating a configuration of a liquid crystal display device according to the above first embodiment.

FIG. 2 is a block diagram illustrating a configuration of a liquid crystal display device 10 according to the first embodiment of the present invention. The liquid crystal display device 10 illustrated in FIG. 2 is equipped with a liquid crystal panel 11, a panel driving circuit 12, a backlight 13, a backlight driving circuit 14, and an area active driving processor 15. This liquid crystal display device 10 conducts area active driving that divides the screen into multiple areas and drives the liquid crystal panel 11 while controlling the backlight source luminance on the basis of an input image within each area. Hereinafter, m and n are taken to be integers equal to or greater than 2, while p and q are taken to be integers equal to or greater than 1, with at least one of p and q being an integer equal to or greater than 2.

An input image 31 that includes an R image, a G image, and a B image is input into the liquid crystal display device 10. The R image, G image, and B image all include luminance for (m×n) pixels. The area active driving processor 15, on the basis of the input image 31, computes display data used to drive the liquid crystal panel 11 (hereinafter designated the liquid crystal data 37), and emission luminance control data used to drive the backlight 13 (hereinafter designated the LED data 34) (details to be discussed later).

The liquid crystal panel 11 is equipped with (m×n×3) display elements 21. The display elements 21 are disposed in a 2D array overall, with 3m elements in a row direction (the horizontal direction in FIG. 2) and n elements in a column direction (the vertical direction in FIG. 2). Included among the display elements 21 are R display elements that transmit red light, G display elements that transmit green light, and B display elements that transmit blue light. The R display elements, G display elements, and B display elements are arranged in the row direction. However, the arrangement of the display elements is not limited to this format. The R display elements, G display elements, and B display elements form respective sub-pixels, with three such sub-pixels forming one pixel. Note that the present invention is also applicable to cases in which one pixel is formed with a number of sub-pixels other than three.

The panel driving circuit 12 is a driving circuit for the liquid crystal panel 11. The panel driving circuit 12, on the basis of liquid crystal data 37 output from the area active driving processor 15, outputs to the liquid crystal panel 11 a signal (voltage signal) that controls the optical transmittance of the display elements 21. Voltages output from the panel driving circuit 12 are written to pixel electrodes inside the display elements 21, and the optical transmittance of the display elements 21 varies according to the voltage written to the pixel electrodes.

Figure 3:
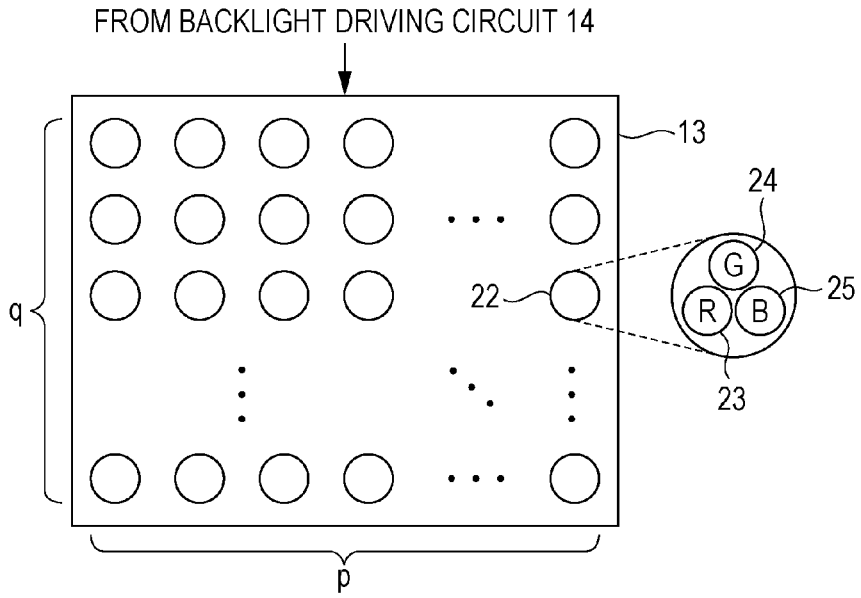
FIG. 3 is a diagram illustrating details of the backlight illustrated in FIG. 2.

The backlight 13 is provided on the rear face side of the liquid crystal panel 11, and shines backlight light onto the rear face of the liquid crystal panel 11. FIG. 3 is a diagram illustrating details of the backlight 13. As illustrated in FIG. 3, the backlight 13 includes (p×q) LED units 22. The LED units 22 are disposed in a 2D array overall, with p units in the row direction, and q units in the column direction. The LED units 22 include one each of a red LED 23, a green LED 24, and a blue LED 25. Light emitted from the three LEDs 23 to 25 included in one LED unit 22 hits a portion of the rear face of the liquid crystal panel 11.

The backlight driving circuit 14 is a driving circuit for the backlight 13. The backlight driving circuit 14, on the basis of LED data 34 output from the area active driving processor 15, outputs to the backlight 13 a signal (pulse signal PWM or a current signal) that controls the luminance of the LEDs 23 to 25. The luminance of the LEDs 23 to 25 is controlled independently of the luminance of LEDs inside a unit and outside a unit.

The screen of the liquid crystal display device 10 is divided into (p×q) areas, with one LED unit 22 associated with one area. However, multiple LED units may also be used as a set for one area, due to reasons such as insufficient luminance. In this case, multiple LED units emit light simultaneously on the basis of a luminance control signal given to one area from the backlight driving circuit 14. For each of the (p×q) areas, the area active driving processor 15 computes, on the basis of the R image within an area, the luminance of the red LED 23 corresponding to that area (the luminance during emission). Similarly, the luminance of the green LED 24 is determined on the basis of the G image within the area, and the luminance of the blue LED 25 is determined on the basis of the B image within the area. The area active driving processor 15 computes the luminance of all LEDs 23 to 25 included in the backlight 13, and outputs to the backlight driving circuit 14 LED data 34 that expresses the computed luminance.

In addition, the area active driving processor 15, on the basis of the LED data 34, computes the luminance of backlight light for all display elements 21 included in the liquid crystal panel 11 (this luminance means the "potentially displayed luminance", and is hereinafter designated the "display luminance"). Furthermore, the area active driving processor 15, on the basis of the input image 31 and the display luminance, computes the optical transmittance of all display elements 21 included in the liquid crystal panel 11, and outputs to the panel driving circuit 12 liquid crystal data 37 that expresses the computed optical transmittance.

In the liquid crystal display device 10, the luminance of an R display element is the product of the luminance of red light emitted from the backlight 13 and the optical transmittance of the R display element. The light emitted from one red LED 23 hits multiple areas, centered on one corresponding area. Consequently, the luminance of an R display element is the product of the total luminance of light emitted from multiple red LEDs 23 and the optical transmittance of the R display element. Similarly, the luminance of a G display element is the product of the total luminance of light emitted from multiple green LEDs 24 and the optical transmittance of the G display element, and the luminance of a B display element is the product of the total luminance of light emitted from multiple blue LEDs 25 and the optical transmittance of the B display element.

According to the liquid crystal display device 10 configured as above, suitable liquid crystal data 37 and LED data 34 is computed on the basis of an input image 31, the optical transmittance of the display elements 21 is controlled on the basis of the liquid crystal data 37, and in addition, the luminance of the LEDs 23 to 25 is controlled on the basis of the LED data 34. In so doing, the input image 31 may be displayed on the liquid crystal panel 11. Also, in the case in which pixels within an area have low luminance, the luminance of the LEDs 23 to 25 corresponding to that area may be lowered, thereby reducing the power consumption of the backlight 13. Also, in the case in which pixels within an area have low luminance, the luminance of the display elements 21 corresponding to that area may be switched among a fewer number of levels, thereby raising the image resolution and improving the quality of the displayed image.

Figure 4:
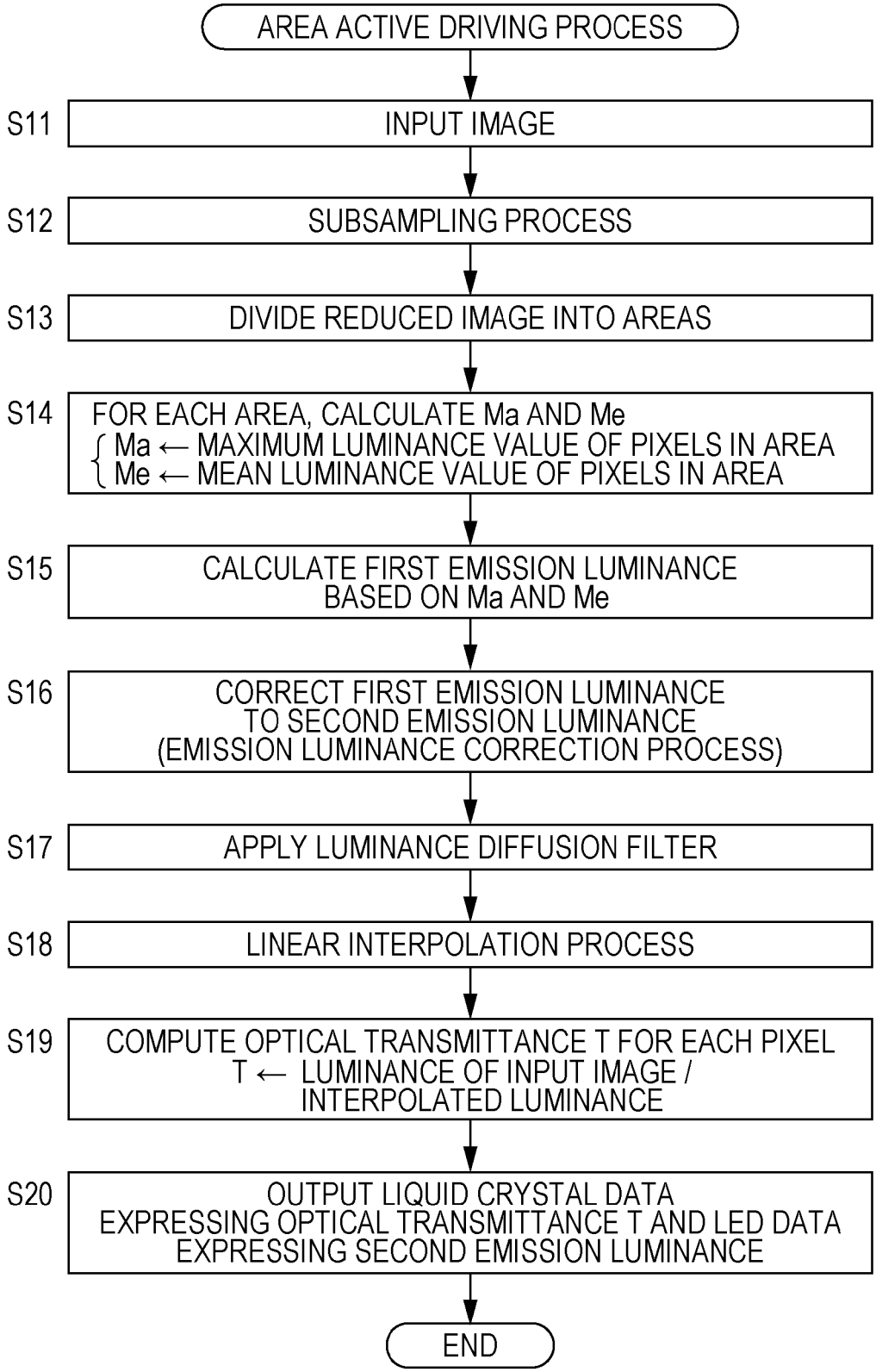
FIG. 4 is a flowchart illustrating a processing sequence of an area active driving processor in the above first embodiment.

FIG. 4 is a flowchart illustrating a processing sequence of the area active driving processor 15. An image of a given chroma component (hereinafter designated the chroma component C) included in the input image 31 is input into the area active driving processor 15 (step S11). The input image of the chroma component C includes the luminance of (m×n) pixels.

Next, the area active driving processor 15 conducts a subsampling processor (averaging process) on the input image of the chroma component C, and computes a reduced image that includes the luminance of (sq×sq) pixels (where s is an integer equal to or greater than 2) (step S12). In step S12, the input image of the chroma component C is reduced by a factor of (sp/m) in the horizontal direction, and by a factor of (sq/n) in the vertical direction. Next, the area active driving processor 15 divides the reduced image into (p×q) areas (step S13). Each area includes the luminance of (s×s) pixels. Next, for each of the (p×q) areas, the area active driving processor 15 computes a maximum value Ma of the luminance of pixels within an area, and a mean value Me of the luminance of pixels within an area (step S14). Next, on the basis of information such as the maximum value Ma and the maximum value Me computed in step S14, the area active driving processor 15 computes the luminance during emission of the LEDs corresponding to each area (step S15). Note that the luminance computed in step S15 is hereinafter designated the "first emission luminance".

Next, the area active driving processor 15 conducts a process of applying designated correction to the first emission luminance computed in step S15 to compute a second emission luminance (hereinafter designated the "emission luminance correction process") (step S16). In the present embodiment, the emission luminance correction process involves at least conducting the LED blur process discussed later. Note that, besides the LED blur process, a process of correcting luminance on the basis of information such as the maximum value Ma and the mean value Me of the luminance of pixels for each area may also be conducted, for example.

Next, the area active driving processor 15 applies a luminance diffusion filter to the (p×q) points of second emission luminance computed in step S16, and thereby computes first backlight luminance data that includes (tp×tq) (where t is an integer equal to or greater than 2) points of display luminance (step S17). In step S17, the (p×q) points of second emission luminance are enlarged by a factor of t in the horizontal direction and the vertical direction, respectively.

Next, the area active driving processor 15 conducts a linear interpolation process on the first backlight luminance data, and thereby computes second backlight luminance data that includes (m×n) points of display luminance (step S18). In step S18, the first backlight luminance data is enlarged by a factor of (m/tp) in the horizontal direction, and by a factor of (n/tq) in the vertical direction. The second backlight luminance data represents the luminance of backlight light for the chroma component C incident on the (m×n) display elements 21 for the chroma component C in the case in which the (p×q)

LEDs for the chroma component C emit light at the second emission luminance computed in step S16.

Next, the area active driving processor 15 respectively divides the luminance of the (m×n) pixels included in the input image of the chroma component C by the (m×n) points of display luminance included in the second backlight luminance data, and thereby computes the optical transmittance T of the (m×n) display elements 21 for the chroma component C (step S19).

Lastly, the area active driving processor 15 outputs, for the chroma component C, liquid crystal data 37 expressing the (m×n) points of optical transmittance T computed in step S19, and LED data 34 expressing the (p×q) points of second emission luminance computed in step S16 (step S20). At this point, the liquid crystal data 37 and the LED data 34 are converted into values in a suitable range matching the specifications of the panel driving circuit 12 and the backlight driving circuit 14.

The area active driving processor 15 conducts the process illustrated in FIG. 4 for the R image, the G image, and the B image, and thereby computes liquid crystal data 37 expressing (m×n×3) points of optical transmittance and LED data 34 expressing (p×q×3) points of second emission luminance, on the basis of an input image 31 that includes the luminance of (m×n×3) pixels.

Figure 5:
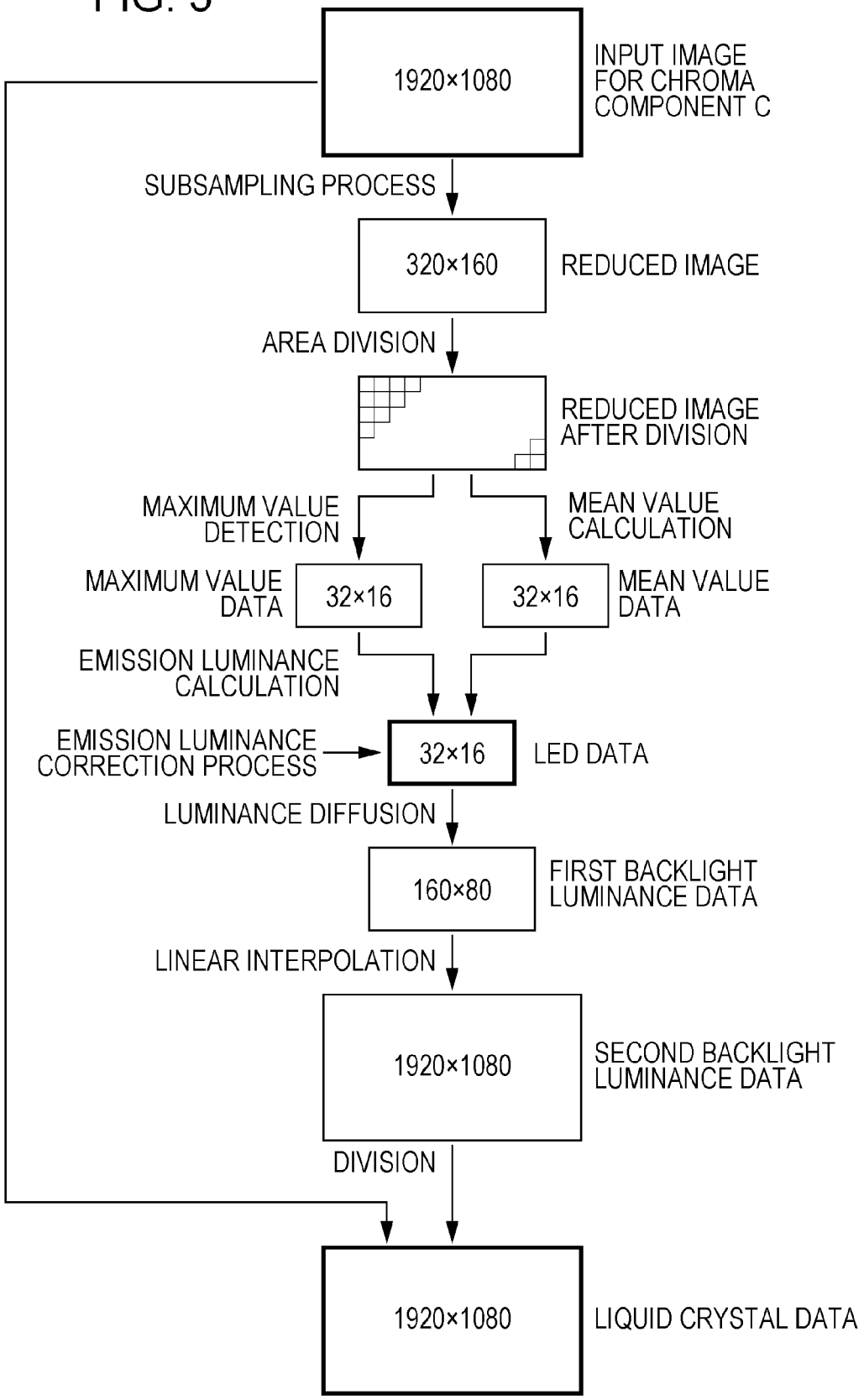
FIG. 5 is a diagram illustrating the course of obtaining liquid crystal data and LED data in the above first embodiment.

FIG. 5 is a diagram illustrating the course of obtaining liquid crystal data 37 and LED data 34 for the case in which m=1920, n=1080, p=32, q=16, s=10, and t=5. As illustrated in FIG. 5, by conducting a subsampling process on the input image of a chroma component C that includes the luminance of (1920×1080) pixels, a reduced image that includes the luminance of (320×160) pixels is obtained. The reduced image is divided into (32×16) areas (the area size is (10×10) pixels). By computing the maximum value Ma and the mean value Me of the pixel luminance for each area, maximum value data that includes (32×16) maximum values, and mean value data that includes (32×16) mean values, are obtained. Furthermore, (32×16) points of emission luminance (first emission luminance) are obtained on the basis of information such as the maximum value data and the mean value data. The first emission luminance is corrected with an emission luminance correction process that includes an LED blur process using an LED filter 155, and LED data 34 for the chroma component C expressing (32×16) points of emission luminance (second emission luminance) is obtained.

By applying a luminance diffusion filter to the LED data 34 for the chroma component C, first backlight luminance data that includes (160×80) points of luminance is obtained, and by conducting a linear interpolation process on the first backlight luminance data, second backlight luminance data that includes (1920×1080) points of luminance is obtained. Finally, by dividing the luminance of pixels included in the input image by the luminance included in the second backlight luminance data, liquid crystal data 37 for the chroma component C that includes (1920×1080) points of optical transmittance is obtained.

Note that in FIGS. 4 and 5, in order to simplify explanation, the area active driving processor 15 is described as successively conducting a process on the image for each chroma component, but a process may also be conducted by time sharing on the image for each chroma component. Also, in FIGS. 4 and 5, the area active driving processor 15 is described as conducting a subsampling process on an input image for the purpose of noise removal, and conducting area active driving on the basis of a reduced image, but may also be configured to conduct area active driving on the basis of the original input image.

<1.2 Configuration of Area Active Driving Processor>

Figure 1:
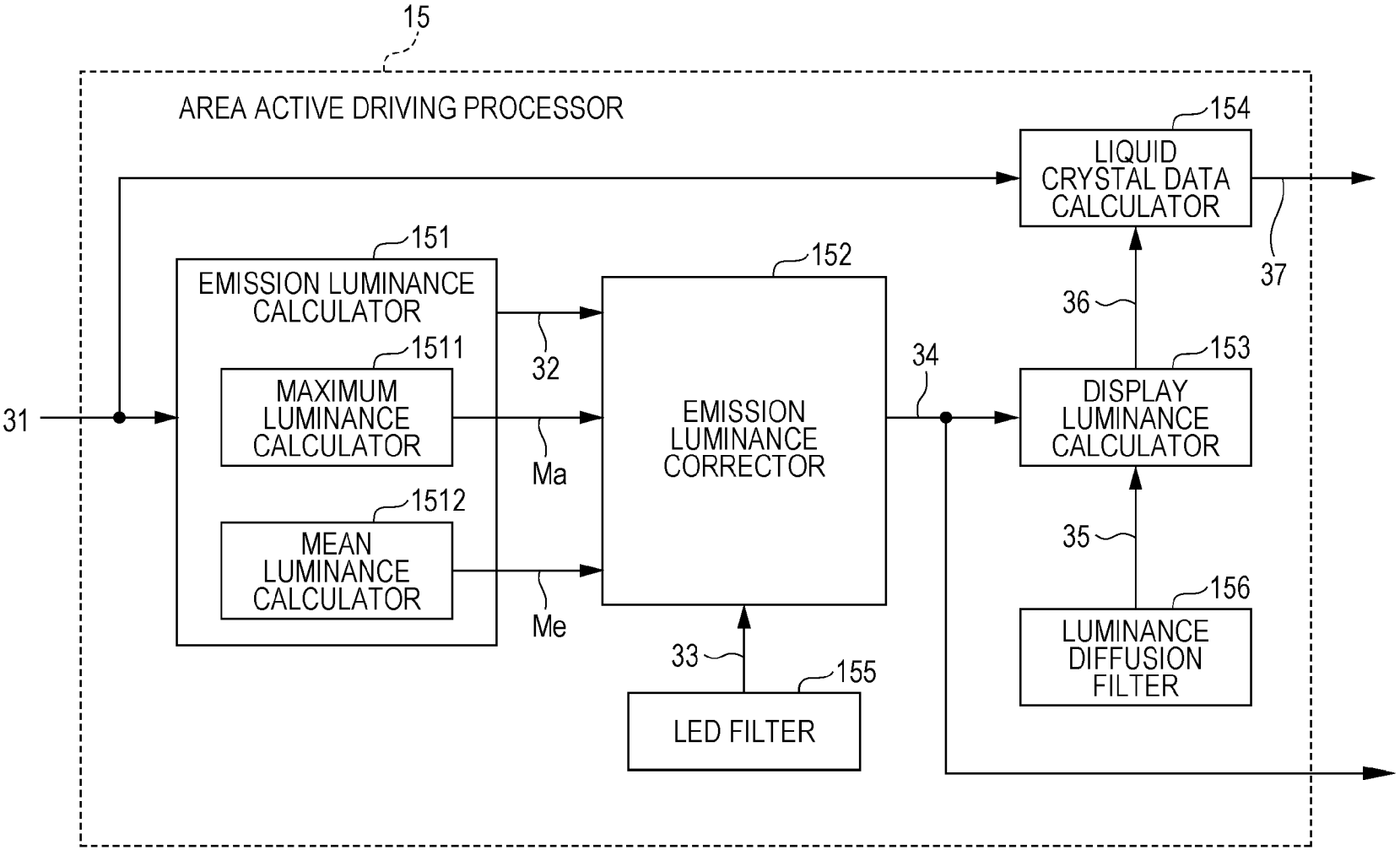
FIG. 1 is a block diagram illustrating a detailed configuration of an area active driving processor according to the first embodiment of the present invention.

FIG. 1 is a block diagram illustrating a detailed configuration of an area active driving processor 15 according to the present embodiment. The area active driving processor 15 is equipped with an emission luminance calculator 151, an emission luminance corrector 152, a display luminance calculator 153, and a liquid crystal data calculator 154, which act as structural elements for executing designated processes, and is equipped with an LED filter 155 and a luminance diffusion filter 156, which act as structural elements for storing designated data. The emission luminance calculator 151 includes a maximum luminance calculator 1511 and a mean luminance calculator 1512.

Note that, in the present embodiment, a display data calculator is realized by the display luminance calculator 153 and the liquid crystal data calculator 154, while a correction filter is realized by the LED filter 155.

The emission luminance calculator 151 divides an input image 31 into multiple areas, and on the basis of that input image 31, computes the luminance 32 during emission of the LEDs corresponding to each area (the first emission luminance discussed earlier). At this point, the maximum luminance calculator 1511 computes the maximum value Ma of the pixel luminance in each area, while the mean luminance calculator 1512 computes the mean value Me of the pixel luminance in each area. The method of calculating the first emission luminance 32 may be, for example, a method of determination on the basis of the maximum value Ma of the pixel luminance within an area, a method of determination on the basis of the mean value Me of the pixel luminance within an area, or a method of determination on the basis of a value obtained from a weighted average of the maximum value Ma and the mean value Me of the pixel luminance within an area. The maximum value Ma, the mean value Me, and the first emission luminance 32 are given to the emission luminance corrector 152.

The LED filter 155 stores data (correction data) 33 for correcting the first emission luminance 32 computed by the emission luminance calculator 151. In the present embodiment, the LED filter 155 is schematically like that illustrated in FIG. 6, for example. Assuming that the luminance (first emission luminance) of a given area (the area labeled with the sign 40 in FIG. 6) is "255", and that the luminance (first emission luminance) of all other areas is "0", the values of the correction data 33 in the LED filter 155 (hereinafter designated "blur values") are values indicating how bright to emit light from LEDs in 49 areas centered on that area 40. Note that the liquid crystal display device in the present embodiment is assumed to present a display using 256 gradations. Also, although an example of storing correction data 33 for 49 areas (7 areas in the vertical direction by 7 areas in the horizontal direction) in the LED filter 155 is illustrated herein, the present invention is not limited thereto. For example, correction data 33 for 25 areas (5 areas in the vertical direction by 5 areas in the horizontal direction) may also be stored in the LED filter 155.

The emission luminance corrector 152 conducts an emission luminance correction process that corrects the first emission luminance to the second emission luminance. As discussed earlier, in the present embodiment, the emission luminance correction process involves conducting at least an LED blur process. In the LED blur process, correction is applied to the first emission luminance 32 calculated by the emission luminance calculator 151, on the basis of blur values stored in the LED filter 155. As a result applying a correction to the first emission luminance with an emission luminance correction process that includes this LED blur process, a second emission luminance is calculated for each area in the panel. LED data 34 indicating the second emission luminance is given to the backlight driving circuit 14, while also being given to the display luminance calculator 153.

The luminance diffusion filter 156 stores numerical data (hereinafter designated "light diffusion data") that indicates how to diffuse light emitted from LEDs in arbitrary areas. More specifically, in the case of assuming that "100" is the value of the luminance exhibited in one area in the case in which the LEDs in that area emit light, the luminance diffusion filter 156 stores, as the above light diffusion data, the values of the luminance exhibited in that area as well as nearby areas. For example, light diffusion data is stored in the luminance diffusion filter 156 as illustrated in FIG. 7.

On the basis of the LED data (second emission luminance) 34 computed by the emission luminance corrector 152 and light diffusion data 35 stored in the luminance diffusion filter 156, the display luminance calculator 153 computes a display luminance 36 for all display elements 21 included in the liquid crystal panel 11. The liquid crystal data calculator 154, on the basis of an input image 31 and the display luminance 36, computes liquid crystal data 37 expressing the optical transmittance of all display elements 21 included in the liquid crystal panel 11.

<1.3 LED Blur Process>

Figures 9, 10:
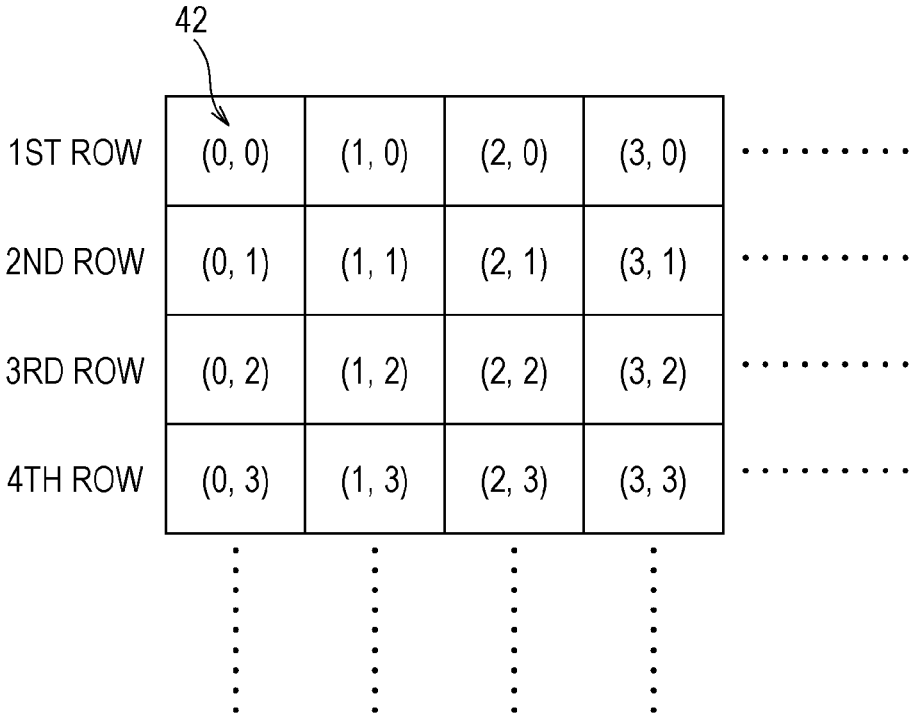
FIG. 9 is a diagram for describing global coordinates.
FIG. 10 is a diagram for describing contribution ratio.

Next, the LED blur process conducted by the emission luminance corrector 152 will be described in detail. First, the terms used in this specification regarding the coordinates for specifying the position of each area will be described. In the case of taking an arbitrary area as a center, the coordinates of nearby areas with reference to that area are designated "local coordinates". Also, the coordinates of each area with reference to the area in the upper-left corner of the panel are designated "global coordinates". For local coordinates, (0, 0) expresses the coordinates of the area at the center, and (i, j) expresses the coordinates of an area positioned ith to the right and jth above the area at the center, taking the rightward direction and upward direction of the panel to be positive. For global coordinates, (0, 0) expresses the coordinates of the area at the upper-left corner of the panel, and (I, J) expresses the coordinates of an area positioned Ith to the right and Jth below the area at the upper-left corner of the panel, taking the rightward direction and downward direction of the panel to be positive. FIG. 8 illustrates the local coordinates of each area in the case in which the area labeled with the sign 41 is set as the center. FIG. 9 illustrates the global coordinates of each area in the case in which the area labeled with the sign 42 is the area at the upper-left corner of the panel.

In the LED blur process, areas within the panel are successively set one by one as the current area, and a correction is applied to the emission luminance of the areas near the current area. During the LED blur process, the emission luminance corrector 152 corrects emission luminance on the basis of blur values stored in the LED filter 155 (the values of the correction data 33). Correction is conducted by applying an LED filter 155 as illustrated in FIG. 6 for each area. For example, first, the LED filter 155 is applied to the area with the global coordinates (0, 0). Doing so computes how bright to emit light from LEDs in areas near the area with the global coordinates (0, 0). Next, the LED filter 155 is applied to the area with the global coordinates (1, 0). Doing so computes how bright to emit light from LEDs in areas near the area with the global coordinates (1, 0). Similarly, the LED filter 155 is applied one area at a time to the remaining areas on the first row. Furthermore, the LED filter 155 is similarly applied one area at a time to the areas on the second and subsequent rows. As a result of the above, the LED filter 155 is applied one area at a time to all areas. Note that in the case in which the emission luminance of the current area is 0, the emission luminance of areas near that current area is not corrected.

In the present embodiment, a correction is applied to areas positioned within a range of 7 areas in the row direction and 7 areas in the column direction, centered on the current area. At this point, first, a contribution ratio corresponding to the respective correction data 33 within the LED filter 155 is computed. For an arbitrary current area (herein, the area labeled with the sign 40 in FIG. 6), the contribution ratio refers to the ratio of the emission luminance of nearby areas versus the emission luminance of the area 40, for the purpose of supplementing the brightness of that area 40 and raising the emission luminance of nearby areas above the original emission luminance. In the present embodiment, the contribution ratio corresponding to respective correction data 33 is computed by dividing the blur values by 255, as illustrated in FIG. 10.

After computing the contribution ratio corresponding to the respective correction data 33, the contribution ratio is used to compute a corrected luminance value for the areas near the current area. Specifically, a corrected luminance value Vlb(i, j) for the area with the local coordinates (i, j) is calculated with the following formula (1).

$$Vlb(i,j)=\mathrm{MAX}(Vlo(i,j),E(i,j)*Vlo(0,0)) \quad (1)$$

Herein, MAX(a, b) is a function that returns the value of the larger of a and b. Vlo(i, j) is the pre-correction luminance value for the area with the local coordinates (i, j). E(i, j) is the contribution ratio for the area with the local coordinates (i, j). Vlo(0, 0) is the pre-correction luminance value for the current area.

Figures 11, 12:
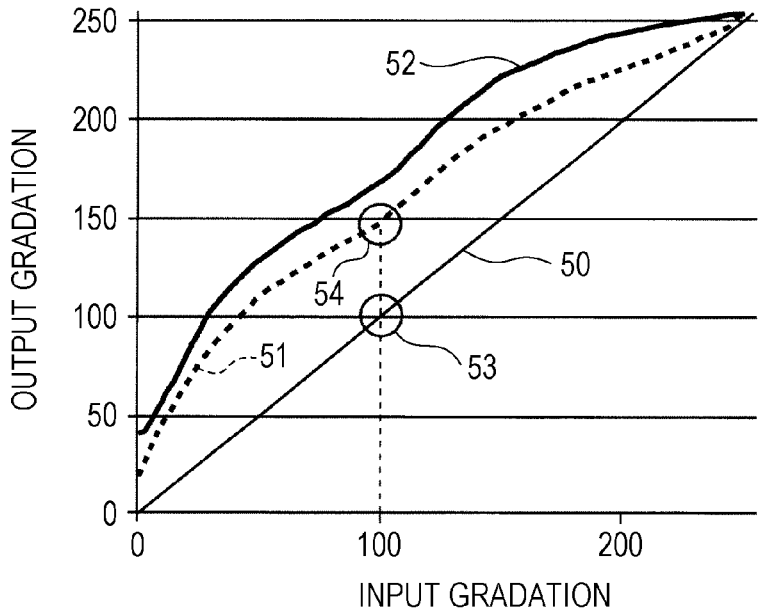
FIG. 11 is a diagram for describing an LED blur process in the above first embodiment.
FIG. 12 is a diagram illustrating an example of liquid crystal gradation performance.
Figure 13:
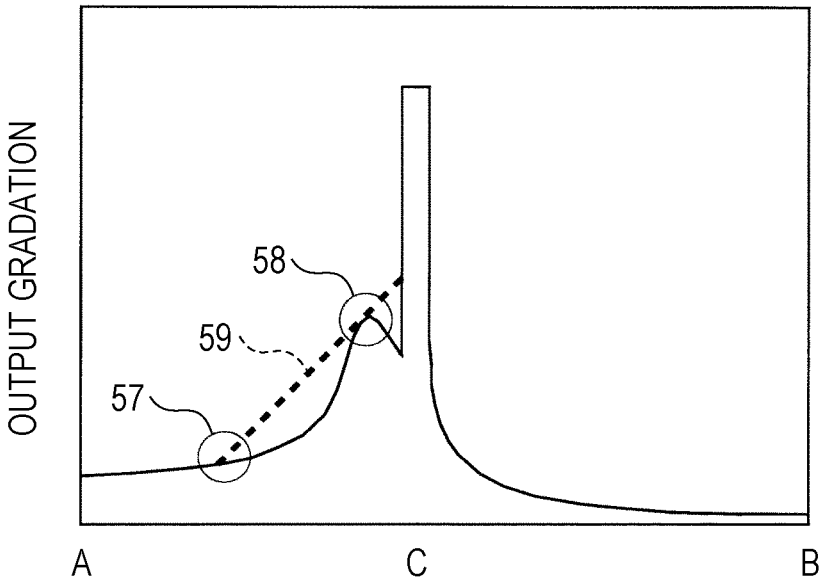
FIG. 13 is a diagram for describing a way of computing a blur value in the above first embodiment.

Meanwhile, for an area with the global coordinates (I, J), a corrected luminance value is calculated with the above formula (1) in the case in which the areas positioned within a range of global coordinates from (I−3, J−3) to (I+3, J+3) are set as respective current areas (see FIG. 11). In other words, for each area, the calculation of a corrected luminance value based on the above formula (1) is conducted multiple times. In this calculation of the corrected luminance value, during the first calculation, the pre-correction luminance value of each area (herein, the first emission luminance) becomes Vlo(i, j) on the right side of the above formula (1). Also, the value of Vlb(i, j) on the left side of the above formula (1) obtained by the (n−1)th calculation becomes Vlo(i, j) on the right side of the above formula (1) during the nth calculation. Subsequently, for each area, the value of Vlb(i, j) obtained by the last calculation from among these multiple calculations becomes the second emission luminance for each area.

<1.4 Way of Computing Blur Value>

Figure 29:
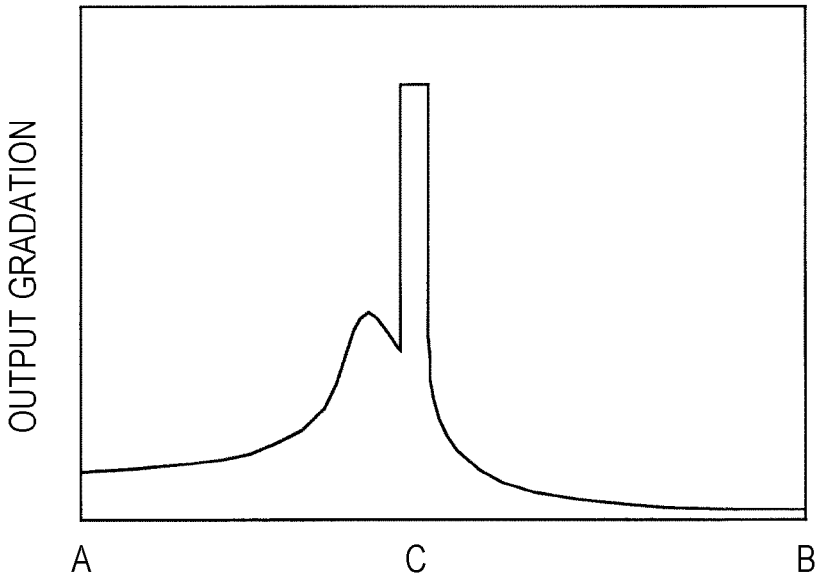
FIG. 29 is a diagram illustrating, for an oblique view, output gradations on the dotted line labeled with the sign 95 in FIG. 25.

Next, a way of computing a blur value will be described with reference to FIGS. 12 to 16. FIG. 12 is a diagram illustrating an example of liquid crystal gradation performance. FIG. 12 illustrates the relationship between input gradations and output gradations in a state of a fully lighted backlight as the liquid crystal performance. In FIG. 12, the thin solid line labeled with the sign 50 represents ideal gradation performance, the thick dotted line labeled with the sign 51 expresses gradation performance in the case of an oblique view from a 45-degree angle (taking a front view to be 0 degrees), and the thick dotted line labeled with the sign 52 expresses gradation performance in the case of an oblique view from a 60-degree angle (taking a front view to be 0 degrees). From the gradation performance illustrated in FIG. 12, it is possible to ascertain how much light bleeding will occur because of the effects of viewing angle performance in the case of an oblique view. For example, in the case in which the input gradation is "100", ideally the output gradation is also "100" (see the portion labeled with the sign 53), but in the case of an oblique view from a 45-degree angle, the output gradation becomes "150" (see the portion labeled with the sign 54). From the above, it is ascertained that in the case of an oblique view, light bleeding of an amount corresponding to the difference therebetween is perceived. Note that gradation performance as illustrated in FIG. 12 may be obtained by using a spectral luminance meter or the like from a desired angle for which to compute gradation performance, and measuring the output gradation corresponding to each input gradation. On the basis of gradation performance computed as above, it is possible to compute an output gradation at each position for an oblique view in the case of assuming that the LED blur is not conducted in the case of displaying an image like that illustrated in FIG. 25, for example (see FIG. 29).

Figure 14:
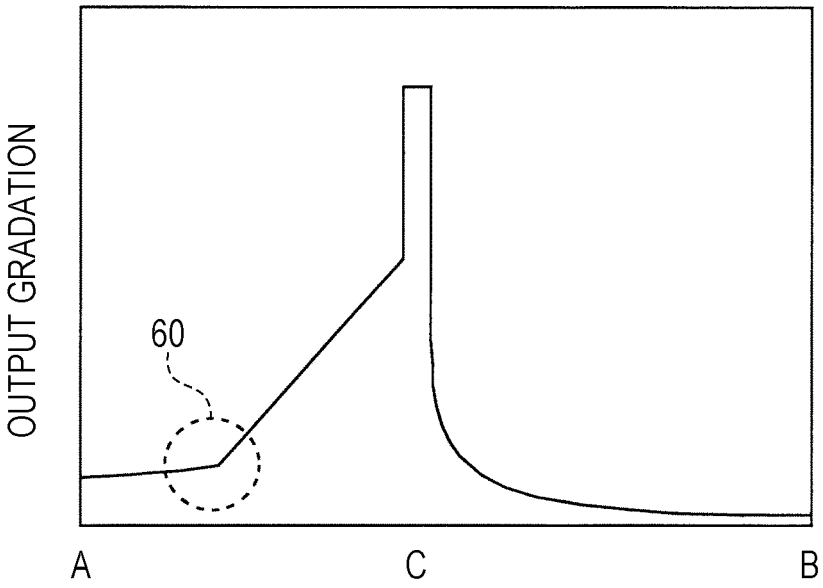
FIG. 14 is a diagram for describing a way of computing a blur value in the above first embodiment.

Meanwhile, mura is easily visible in a region of contiguous, approximately equal input gradations, and in addition, a region in which a portion whose gradations are displayed normally, and a portion whose output gradations are shifted from the original gradations, are neighboring each other. Consequently, by intentionally inducing light bleeding in a region in which mura occurs and smoothing out the (spatial) variation in output gradations in that region, it is conceivable that the mura will become less visible. In addition, the range over which emission luminance correction is possible with the LED blur process is determined by the size of the LED filter 155. Accordingly, on a graph like that illustrated in FIG. 29, by drawing a straight line (the thick dotted line labeled with the sign 59 in FIG. 13) that passes through the outermost edge portion of the range over which emission luminance correction is possible (the portion labeled with the sign 57 in FIG. 13) and the peak portion of the light bleeding magnitude (the portion labeled with the sign 58 in FIG. 13), it is possible to compute an ideal luminance distribution (a distribution of output gradations) in which mura is less visible, as illustrated in FIG. 14.

Note that since human visual performance has the characteristic of perceiving with an emphasis on outlines, it is preferable for the LED blur process to determine blur values such that the output gradation variation (spatial variation, not temporal variation) becomes smoother. For example, in the case of obtaining a graph like that illustrated in FIG. 14 by drawing, on a graph like that illustrated in FIG. 29, a straight line that passes through the outermost edge portion of the range over which emission luminance correction is possible and the peak portion of the light bleeding magnitude, it is sufficient to smoothen the output gradation variation in the portion labeled with the sign 60 in FIG. 14 and obtain gradation variation like that labeled with the sign 61 in FIG. 15.

At this point, provided that G is the liquid crystal gradation, L is the luminance of the backlight source (in the present embodiment, LEDs), Lmax is the maximum value of the backlight source luminance, f(G) is a function expressing the gradation performance in an oblique view, and $\gamma$ is the gamma value, the following formula (Eq1) (a first equation) is established for the output gradation $\alpha$ in a front view, and the following formula (Eq2) (a second equation) is established for an ideal output gradation $\beta$ in an oblique view. Note that f(G) is computed according to the performance of the liquid crystal panel 11 used in the liquid crystal display device 10. Specifically, an approximation formula or lookup table values are adopted.

[Math. 3]

$$\alpha = \left(G^{\gamma} \cdot \frac{L}{L\max}\right)^{\frac{1}{\gamma}} \quad \text{(Eq 1)}$$

[Math. 4]

$$\beta = \left((f(G) \cdot G)^{\gamma} \cdot \frac{L}{L\max}\right)^{\frac{1}{\gamma}} \quad \text{(Eq 2)}$$

Figure 15:
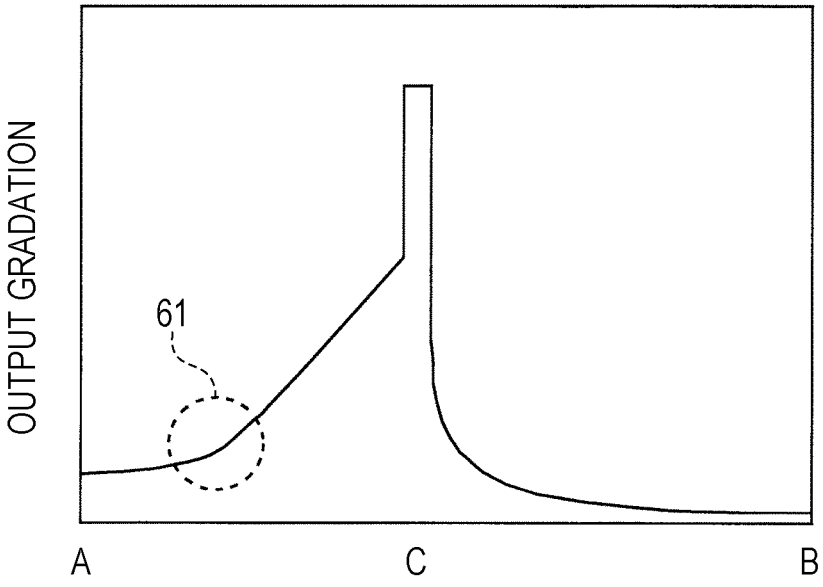
FIG. 15 is a diagram for describing a way of computing a blur value in the above first embodiment.
Figure 28:
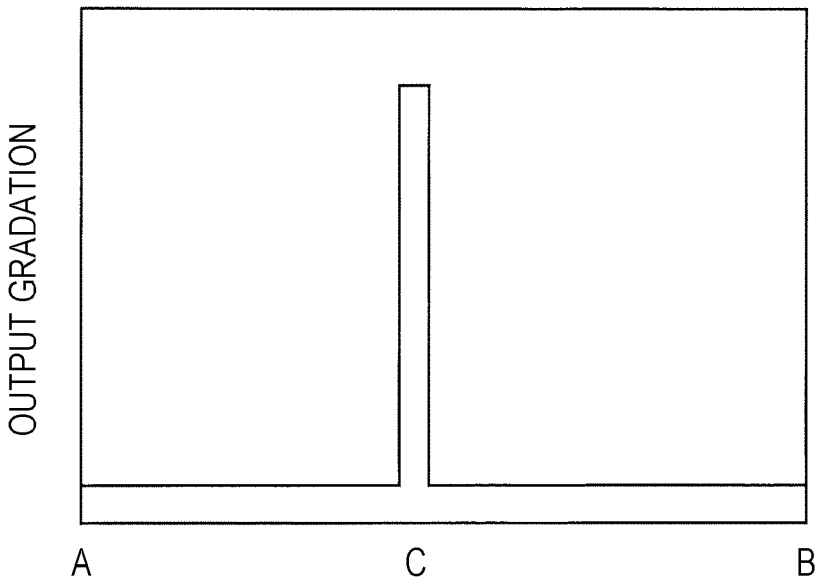
FIG. 28 is a diagram illustrating, for a front view, output gradations on the dotted line labeled with the sign 95 in FIG. 25.

If the above formula (Eq1) corresponds to the graph illustrated in FIG. 28, for example, and the above formula (Eq2) corresponds to the graph illustrated in FIG. 15, for example, there are many combinations of liquid crystal data 37 (corresponds to liquid crystal gradations) and LED data 34 (corresponds to backlight source luminance) for one output gradation. In other words, there are many combinations of a value of G and a value of L that satisfy the above formula (Eq1), and likewise, there are many combinations of a value of G and a value of L that satisfy the above formula (Eq2). Also, for each position in FIG. 28 and FIG. 15, the values other than the values of G and L are fixed values in the above formula (Eq1) and the above formula (Eq2). Accordingly, by solving the system of equations made up of the above formula (Eq1) and the above formula (Eq2), the luminance L of the backlight source may be computed. The value of L computed with this system of equations is the luminance of the backlight source in the case of obtaining an ideal luminance distribution (a distribution of output gradations) in an oblique view. Consequently, blur values may be computed on the basis of the difference between the backlight source luminance in the hypothetical case of not conducting the LED blur process, and the above value of L.

Figures 16, 17:
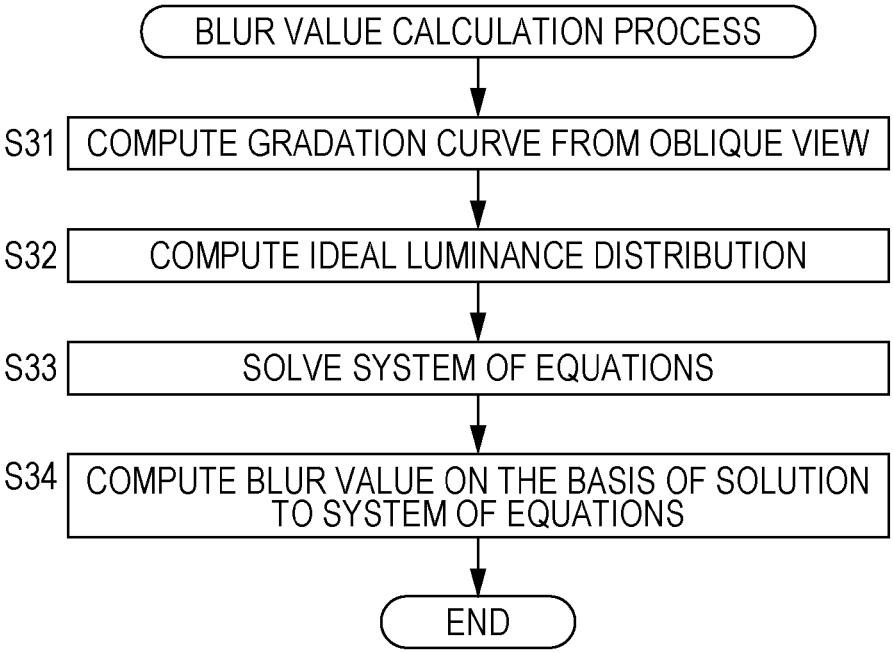
FIG. 16 is a flowchart illustrating a sequence of a blur value calculating process in the above first embodiment.
FIG. 17 is a diagram illustrating an example of an LED filter in an exemplary modification of the above first embodiment.

Given the above, the sequence of a process of computing a blur value (a blur value calculating process) will now be described. FIG. 16 is a flowchart illustrating a sequence of a blur value calculating process in the present embodiment. First, gradation performance from an oblique view is computed for the relevant liquid crystal panel 11 (step S31). In step S31, gradation performance for at least one angle is computed by using a spectral luminance meter or the like to measure the output gradation corresponding to each input gradation. Next, on the basis of the gradation performance at the maximum angle (taking the front view to be 0 degrees) for which control of the mura on the relevant liquid crystal panel 11 is attempted, an ideal luminance distribution (a distribution of output gradations) with less visible mura is computed (step S32). Next, by solving the system of equations made up of the above formula (Eq1) and the above formula (Eq2) for each pixel within the range over which emission luminance is corrected by the LED blur process, the liquid crystal gradation G and the luminance L of the backlight source is computed (step S33). Lastly, each blur value in the LED filter 155 is computed on the basis of the difference between the backlight source luminance computed in step S33 and the backlight source luminance in the hypothetical case of not conducting the LED blur process (step S34).

To restate differently the above details regarding a way of computing a blur value, provided that a first image is defined as an image displayed on the liquid crystal panel 11 in the case of being externally provided with, as the input image 31, an image in which a high-gradation region and a low-gradation region neighbor each other, the emission brightness corrector 152 uses the LED filter 155 to compute a second emission luminance, thereby computing the values of respective correction data 33 stored in the LED filter 155 (blur values) so as to yield a constant degree of spatial variation in the output gradations between the high-gradation region and the low-gradation region in the case of viewing the first image from a designated oblique direction. In addition, provided that a target output gradation distribution is defined as a distribution of output gradations that yields a constant degree of spatial variation in the output gradations between the high-gradation region and the low-gradation region in the case of viewing the first image from a designated oblique direction, the target output gradation distribution between the high-gradation region and the low-gradation region is expressed by a straight line that passes through the outermost edge portion at which the first emission luminance 32 is correctable by applying the LED filter 155 to areas of the high-gradation region, and the maximal portion of output gradations expressed between the high-gradation region and the low-gradation region while viewing the first image from a designated oblique direction in the hypothetical case of not applying correction to the first emission luminance 32.

<1.5 Advantageous Effects>

According to the present embodiment, in a liquid crystal display device that conducts area active driving, the emission luminance of LEDs corresponding to each area is computed on the basis of an input image 31, and then that emission luminance is corrected by conducting an LED blur process on the basis of an LED filter 155. In the LED blur process, in the case in which an LED is lighted in a given area (the area to be lighted), the emission luminance of areas near the area to be lighted is corrected by raising the emission luminance of the LEDs in the areas near the area to be lighted, thereby raising the luminance displayed in the area to be lighted. Herein, in the present embodiment, blur values in the LED filter 155 are computed so as to intentionally induce light bleeding in regions in which mura is perceived in an oblique view, and thereby smoothen the spatial variation in the output gradations. For this reason, the occurrence of mura in an oblique view is moderated in an image display device that conducts area active driving.

<1.6 Exemplary Modifications, Other>

In the foregoing embodiment, backlight source luminance is computed by solving a system of equations made up of the above formula (Eq1) and the above formula (Eq2). Regarding this point, as long as the effects due liquid crystal viewing angle performance and disparity differ depending on angle, and a luminance distribution (a distribution of output gradations) that yields less visible mura is obtained, the precision of the backlight source luminance computed with the above system of equations does not need to be higher than necessary.

Since the LED blur process applies a correction to raise the backlight source luminance, there is a risk of increasing power consumption compared to a liquid crystal display device of the related art. Accordingly, in order to moderate increases in power consumption, a fixed limit on the luminance increment by the LED blur process may also be provided. In other words, the LED blur process may also be conducted such that the difference between the second emission luminance and the first emission luminance is less than or equal to a predetermined limit value.

For an oblique view, the effects due to liquid crystal viewing angle performance and disparity lessen with smaller angles. Also, the liquid crystal gradation performance does not change greatly in the case of slightly changing the angle. For this reason, if the emission luminance is adjusted to make mura less visible at a given angle, mura will also become less visible in the case of viewing the screen from angles smaller than that angle. Consequently, in order to make mura less visible in oblique views up to a given angle, it is sufficient to compute the liquid crystal viewing angle performance from that angle, and compute blur values on the basis of the computed view angle performance.

Also, in order to avoid steep spatial variation in output gradations, it is necessary to widen the range over which the emission luminance is corrected by the LED blur process. A conceivable technique for realizing this is to increase the number of areas inside the LED filter 155. Another conceivable technique is to prepare an LED filter as schematically illustrated in FIG. 17 so as to moderate increases in required memory capacity, and compute blur values by linear interpolation for the areas that are not given a blur value.

<2. Second Embodiment>

<2.1 Configuration>

Next, a second embodiment of the present invention will be described. Since the overall configuration as well as the configuration of the area active driving processor 15 are similar to the foregoing first embodiment (see FIGS. 1 to 7), description thereof will be reduced or omitted.

<2.2 Emission Luminance Correction Process>

Figure 18:
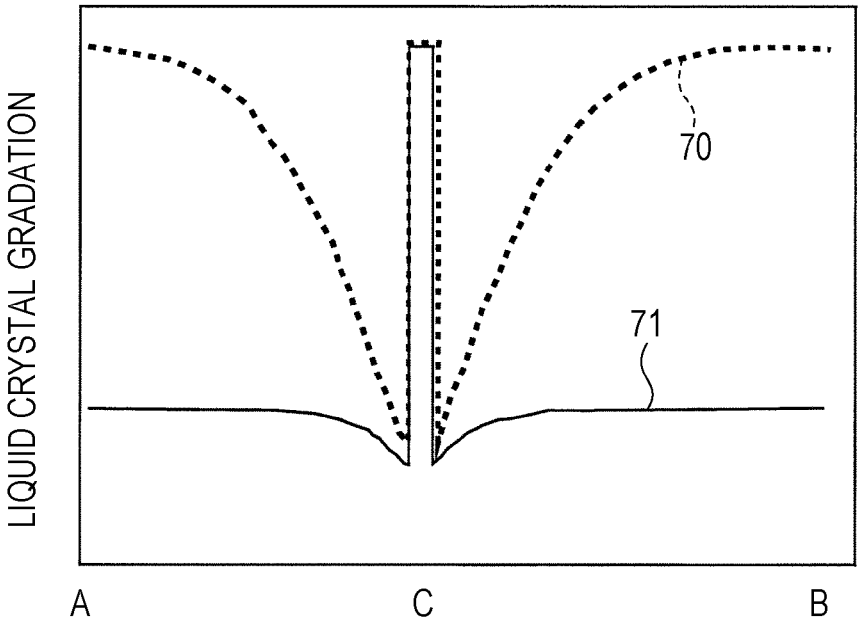
FIG. 18 is a diagram for describing the difference between the case of not providing a lower limit to the second emission luminance and the case of providing a lower limit to the second emission luminance in the second embodiment of the present invention.
Figure 19:
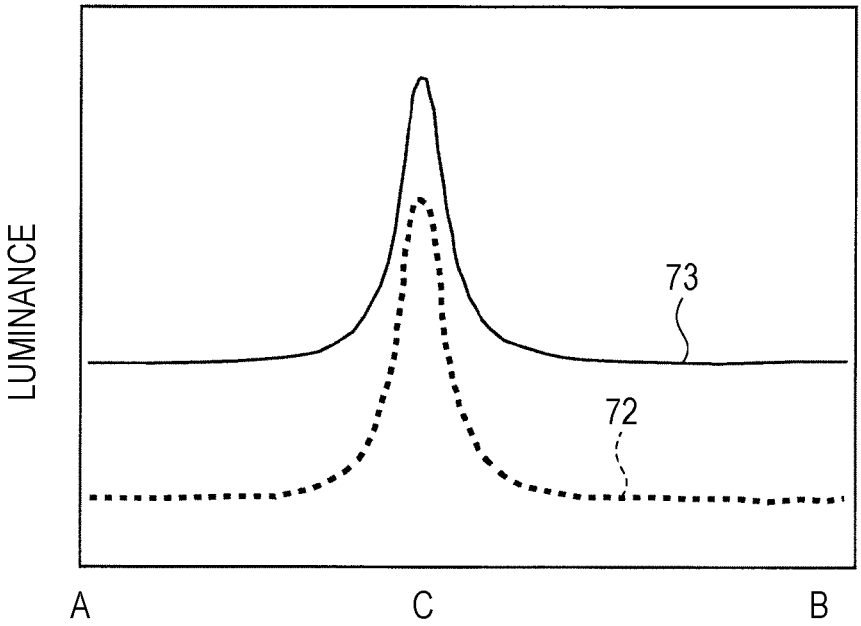
FIG. 19 is a diagram for describing the difference between the case of not providing a lower limit to the second emission luminance and the case of providing a lower limit to the second emission luminance in the above second embodiment.

In the present embodiment, in the case in which the emission brightness corrector 152 corrects the emission luminance (corrects the first emission luminance to the second emission luminance), a lower limit (threshold) is provided for the second emission luminance (corresponds to backlight source luminance). FIGS. 18 and 19 are diagrams for describing the difference between the case of not providing a lower limit to the second emission luminance and the case of providing a lower limit to the second emission luminance. FIG. 18 illustrates the liquid crystal performance at each position in the case of displaying an image like that illustrated in FIG. 25. Note that the liquid crystal gradations in the case of not providing a lower limit are represented by the bold dotted line labeled with the sign 70, while the liquid crystal gradations in the case of providing a lower limit are represented by the thin solid line labeled with the sign 71. FIG. 19 illustrates the luminance (backlight source luminance) at each position in the case of displaying an image like that illustrated in FIG. 25. Note that the luminance in the case of not providing a lower limit is represented by the bold dotted line labeled with the sign 72, while the luminance in the case of providing a lower limit is represented by the thin solid line labeled with the sign 73.

Figure 25:
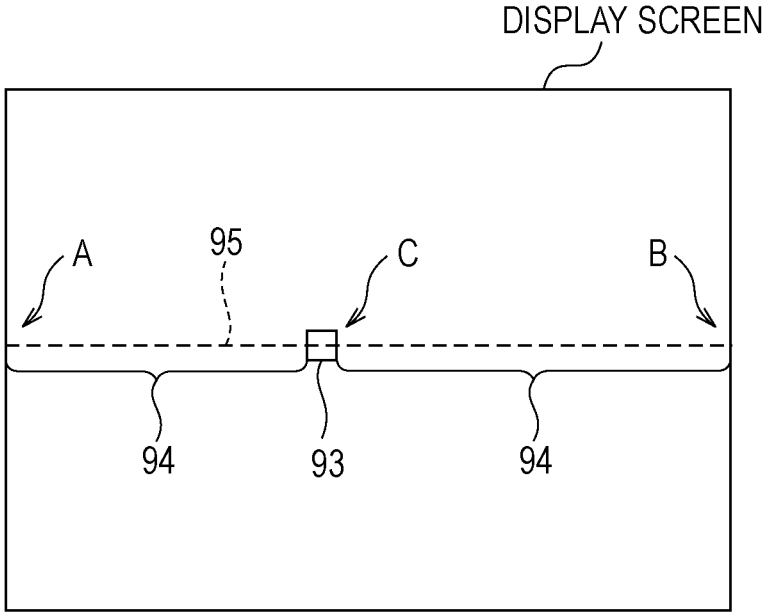
FIG. 25 is a diagram that schematically illustrates an image that includes a small white window inside a fixed-gradation (for example, a black gradation) background.
Figure 26:
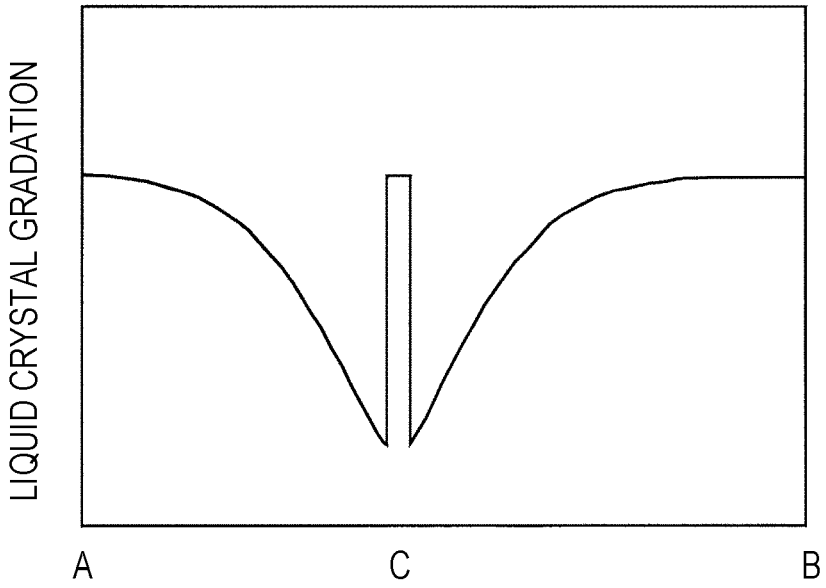
FIG. 26 is a diagram illustrating liquid crystal gradations on the dotted line labeled with the sign 95 in FIG. 25.
Figure 27:
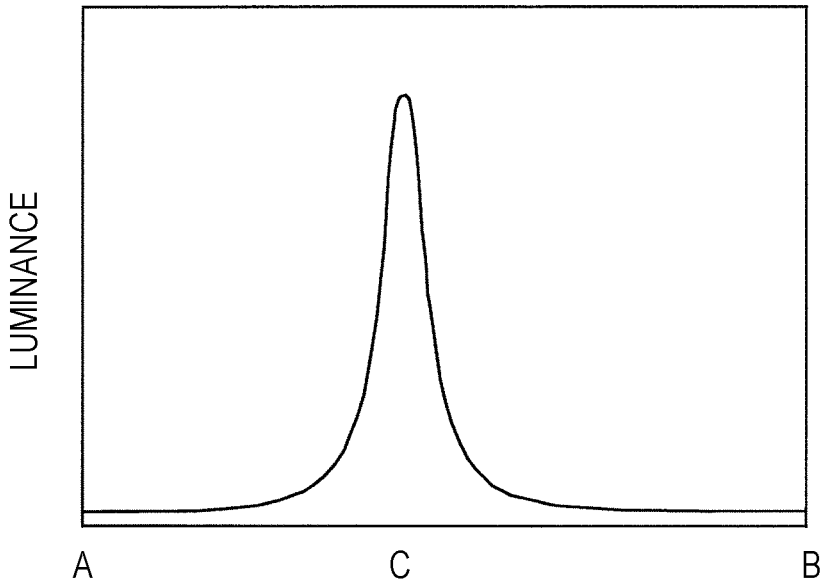
FIG. 27 is a diagram illustrating luminance (backlight source luminance) on the dotted line labeled with the sign 95 in FIG. 25.

In the case of displaying an image like that illustrated in FIG. 25, if a lower limit is provided, the backlight source luminance rises overall compared to the case of not providing a lower limit, as illustrated in FIG. 19. For this reason, if a lower limit is provided, the liquid crystal gradations become smaller compared to the case of not providing a lower limit, as illustrated in FIG. 18.

<2.3 Advantageous Effects>

Figure 20:
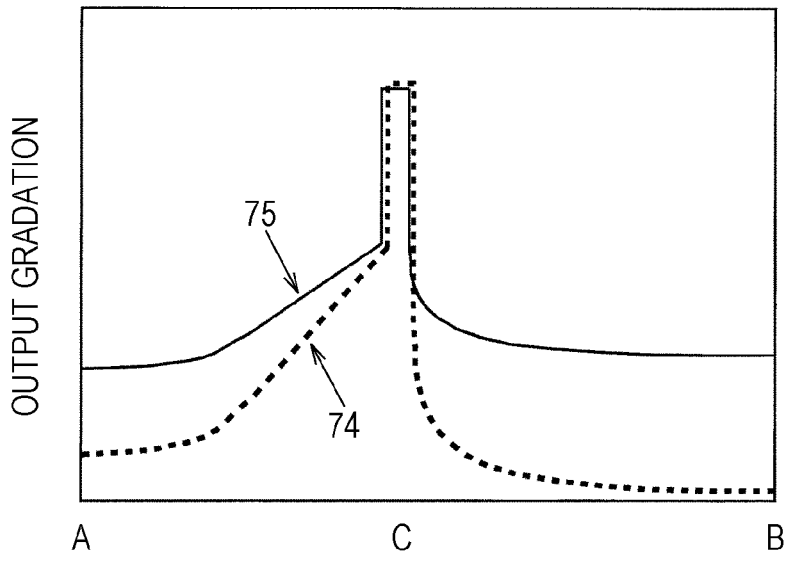
FIG. 20 is a diagram for describing the difference between the case of not providing a lower limit to the second emission luminance and the case of providing a lower limit to the second emission luminance in the above second embodiment.

According to the present embodiment, a lower limit on the backlight source luminance is provided. For this reason, spatial variation in output gradations in an oblique view that was like that indicated by the thick dotted line in FIG. 20 in the case of not providing a lower limit becomes like that indicated by the thin solid line in FIG. 20 in the present embodiment. In the case of not providing a lower limit, if an input image with large spatial variation in gradations as illustrated in FIG. 25 is given, the degree of variation (the slope) of the output gradations increases like in the portion indicated by the arrow labeled with the sign 74 in FIG. 20, even if the LED blur process applies a correction to the emission luminance so that the variation in output gradations becomes constant from an oblique view. As a result, mura is visible in the case of not providing a lower limit. This is because the relationship between gradation and luminance is an exponential function (luminance is gradation to the γ-th power), and in low-gradation portions in particular, slight differences in luminance exert a large effect on the value of the output gradation. In contrast, if a lower limit is provided as in the present embodiment, the degree of variation (the slope) of the output gradations decreases like in the portion indicated by the arrow labeled with the sign 75 in FIG. 20. For this reason, the occurrence of mura is moderated. In this way, according to the present embodiment, the occurrence of mura is more effectively moderated compared to the foregoing first embodiment.

Note that if the lower limit of the second emission luminance is set to a comparatively high value, the backlight source luminance will rise overall and the liquid crystal gradations will decrease, thereby moderating the occurrence of mura even if given an input image in which a high-gradation portion and a low-gradation portion neighbor each other. However, the advantageous effects of lowered power consumption and high contrast obtained by conducting area active driving will be reduced.

In addition, in the case of setting the lower limit of the second emission luminance to a comparatively low value, the effects due to setting a lower limit will be exerted on only portions of originally low luminance (the luminance computed in the hypothetical case of not providing a lower limit). However, this does not pose a problem, since mura is rarely visible in cases in which there are no portions of low luminance on the display screen.

<3. Third Embodiment>

<3.1 Configuration>

Next, a third embodiment of the present invention will be described. Since the overall configuration as well as the configuration of the area active driving processor 15 are similar to the foregoing first embodiment (see FIGS. 1 to 7), description thereof will be reduced or omitted.

<3.2 LED Filter>

Figure 21:
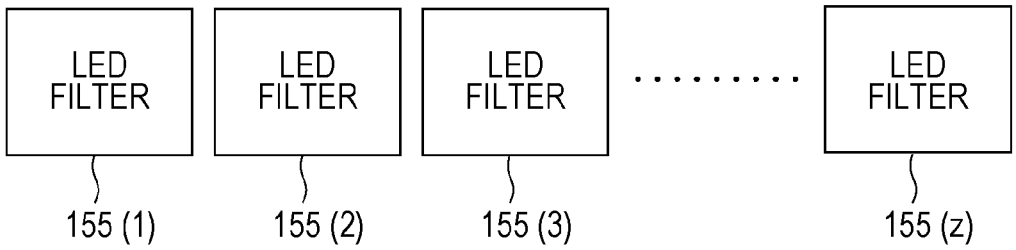
FIG. 21 is a diagram for describing LED filter selection in the third embodiment of the present invention.
Figure 22:
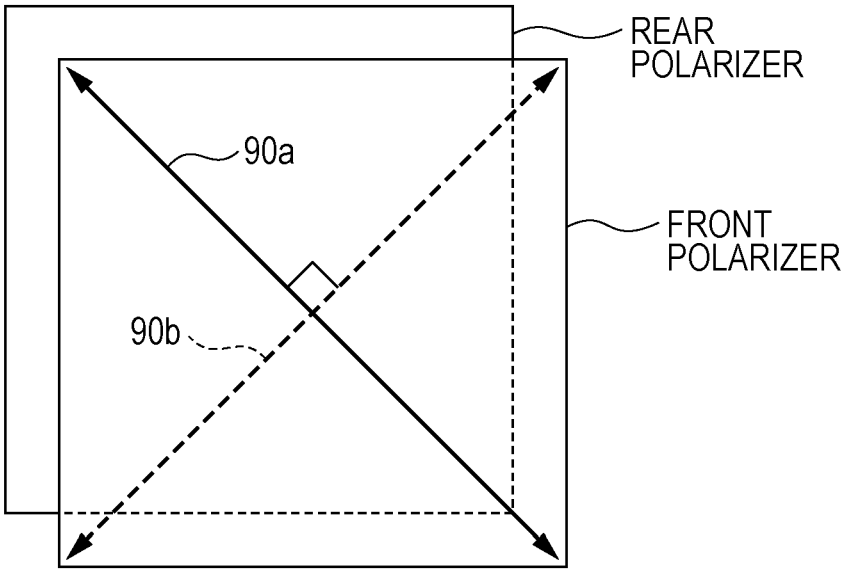
FIG. 22 is a diagram for describing the viewing angle performance of polarizers used in a liquid crystal display device.
Figure 23:
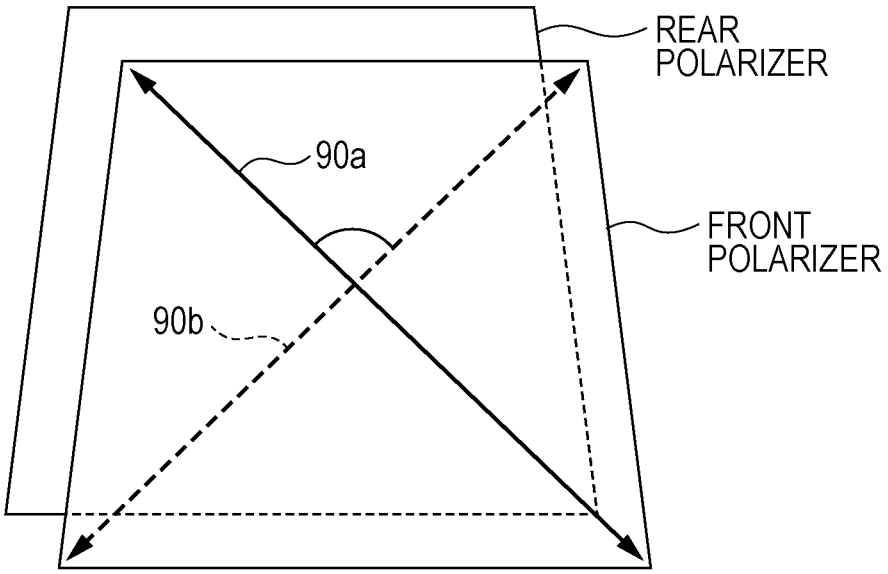
FIG. 23 is a diagram for describing the viewing angle performance of polarizers used in a liquid crystal display device.
Figure 24:
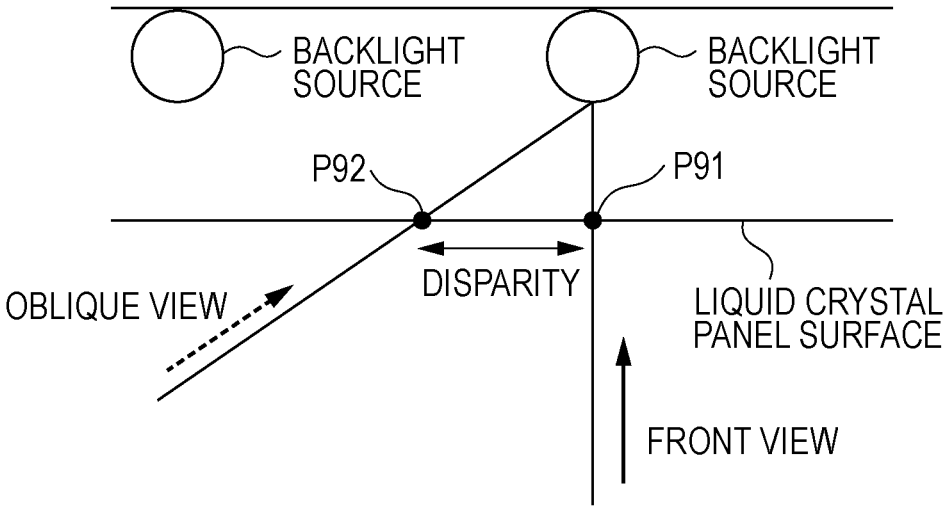
FIG. 24 is a diagram for describing disparity.

In the foregoing first embodiment and the foregoing second embodiment, a single LED filter 155 is used, but in the present embodiment, multiple LED filters are prepared in advance, and an LED filter to be used during the LED blur process is dynamically selected according to the input image 31. Specifically, LED filters set with blur values suitable for moderating mura are created in advance for each of multiple images in which mura readily occurs. As a result, z LED filters 155(1) to 155(*z*) are prepared in advance, as illustrated in FIG. 21, for example. Subsequently, in the case of actually being given an input image 31, one from among the z LED filters 155(1) to 155(*z*) is selected on the basis of the difference between the maximum gradation and the minimum gradation in the input image 31, for example.

Note that the LED filter selection method is not limited to the above method. For example, one LED filter may also be selected on the basis of the difference between the maximum gradation in the input image 31 and the mean gradation of the input image 31, for example. In addition, rather than preparing multiple LED filters in advance, every time an input image 31 is given, respective blur values within the LED filter 155 may also be computed on the basis of that input image 31.

<3.3 Advantageous Effects>

According to the present embodiment, an LED blur process is conducted using an LED filter that includes blur values set to more suitable values according to an input image 31. For this reason, the occurrence of mura is effectively moderated, irrespective of the content of the input image 31.

<4. Other>

Although each of the foregoing embodiments have been described by taking a liquid crystal display device as an example, the present invention is not limited thereto. By computing blur values and conducting an LED blur process as described in the foregoing in an arbitrary image display device equipped with a backlight, it is possible to obtain similar advantageous effects as the case of a liquid crystal display device.

REFERENCE SIGNS LIST

10 Liquid crystal display device
11 Liquid crystal panel
12 Panel driving circuit
13 Backlight
14 Backlight driving circuit
15 Area active driving processor
31 Input image
32 First emission luminance
33 Correction data
34 LED data (second emission luminance)
35 Light diffusion data
36 Display luminance
37 Liquid crystal data
151 Emission luminance calculator
152 Emission luminance corrector
153 Display luminance calculator
154 Liquid crystal data calculator
155 LED filter
156 Luminance diffusion filter

The invention claimed is:

1. An image display device including a backlight made up of a plurality of light sources, and having a function of controlling the luminance of each light source of the backlight, the image display device characterized by comprising:

a display panel, including a plurality of display elements, that displays an image based on an externally given input image;

an emission luminance calculator that divides the input image into a plurality of areas, and on the basis of an input image corresponding to each area, computes a luminance during emission of light sources corresponding to each area as a first emission luminance;

a correction filter that stores correction data for a designated number of areas near a single area;

an emission luminance corrector that computes a second emission luminance by applying the correction filter to each area and correcting the first emission luminance on the basis of the correction data;

a display data calculator that, on the basis of the input image and the second emission luminance, computes display data for controlling optical transmittance of the display elements;

a panel driving circuit that, on the basis of the display data, outputs to the display panel a signal controlling the optical transmittance of the display elements; and a backlight driving circuit that, on the basis of the second emission luminance, outputs to the backlight a signal controlling the luminance of each light source;

wherein, provided that a first image is defined as an image displayed on the display panel in the case of being externally given an image in which a high-gradation region and a low-gradation region neighbor each other as the input image, the emission luminance corrector uses the correction filter to compute the second emission luminance, thereby setting each correction data value stored in the correction filter so as to yield a constant degree of spatial variation in output gradations between the high-gradation region and the low-gradation region in the case of viewing the first image from a designated oblique direction.

2. The image display device according to claim 1, characterized in that provided that a target output gradation distribution is defined as a distribution of output gradations that yields a constant degree of spatial variation in output gradations between the high-gradation region and the low-gradation region in the case of viewing the first image from a designated oblique direction, the target output gradation distribution between the high-gradation region and the low-gradation region is expressed by a straight line that passes through an outermost edge portion at which the first emission luminance is correctable by applying the correction filter to areas of the high-gradation region, and a maximal portion of output gradations expressed between the high-gradation region and the low-gradation region while viewing the first image from a designated oblique direction in a hypothetical case of not applying correction to the first emission luminance.

3. The image display device according to claim 2, characterized in that a value of the correction data is set to a value of a difference between a luminance of the backlight obtained on the basis of a system of equations made up of a first equation expressing a distribution of output gradations in the case of viewing the first image from a front direction and a second equation expressing the target output gradation distribution, and a luminance of the backlight in a hypothetical case of not applying a correction to the first emission luminance.

4. The image display device according to claim 3, characterized in that the first equation is expressed by the following formula (Eq1):

[Math. 5]

$$\alpha = \left(G^{\gamma} \cdot \frac{L}{L\max}\right)^{\frac{1}{\gamma}} \quad \text{(Eq 1)}$$

and the second equation is expressed by the following formula (Eq2):

[Math. 6]

$$\beta = \left((f(G) \cdot G)^{\gamma} \cdot \frac{L}{L\max}\right)^{\frac{1}{\gamma}} \quad \text{(Eq 2)}$$

where G is a gradation based on the display data, L is a luminance of the light sources, Lmax is a maximum value of the luminance of the light sources, f(G) is a function expressing gradation performance while viewing an image from an oblique direction, $\gamma$ is a gamma value, $\alpha$ is an output gradation in the case of viewing the first image from a front direction, and $\beta$ is an output gradation in the case of viewing the first image from the designated oblique direction.

5. The image display device according to claim 1, characterized in that the emission luminance corrector computes the second emission luminance so that the difference between the second emission luminance and the first emission luminance is less than or equal to a predetermined limit.

6. The image display device according to claim 1, wherein the emission luminance corrector computes the second emission luminance so that the second emission luminance is equal to or greater than a predetermined lower limit.

7. The image display device according to claim 1, characterized in that a plurality of correction filters are provided in advance, and the emission luminance corrector selects a correction filter to use while correcting the first emission luminance according to the input image.

8. The image display device according to claim 1, characterized in that every time an input image is externally given, each correction data value stored in the correction filter is computed on the basis of that input image.

9. An image display method for an image display device equipped with a display panel that includes a plurality of display elements and displays an image based on an externally given input image, and a backlight made up of a plurality of light sources, the image display method characterized by comprising:

an emission luminance calculating step that divides the input image into a plurality of areas, and on the basis of an input image corresponding to each area, computes a luminance during emission of light sources corresponding to each area as a first emission luminance;

an emission luminance correcting step that computes a second emission luminance by applying a correction filter storing correction data to each of a designated number of areas near a single area, and correcting the first emission luminance on the basis of the correction data;

a display data calculating step that, on the basis of the input image and the second emission luminance, computes display data for controlling optical transmittance of the display elements;

a panel driving step that, on the basis of the display data, outputs to the display panel a signal controlling the optical transmittance of the display elements; and a backlight driving step that, on the basis of the second emission luminance, outputs to the backlight a signal controlling the luminance of each light source;

wherein, provided that a first image is defined as an image displayed on the display panel in the case of being externally given an image in which a high-gradation region and a low-gradation region neighbor each other as the input image, the emission luminance correcting step uses the correction filter to compute the second emission luminance, thereby setting each correction data value stored in the correction filter so as to yield a constant degree of spatial variation in output gradations between the high-gradation region and the low-gradation region in the case of viewing the first image from a designated oblique direction.

* * * * *